US011419773B2

(12) United States Patent
Babb et al.

(10) Patent No.: US 11,419,773 B2
(45) Date of Patent: Aug. 23, 2022

(54) CONVERTIBLE WHEELCHAIR

(71) Applicant: The Onward Project, LLC, Bend, OR (US)

(72) Inventors: Geoffrey D. Babb, Bend, OR (US); John R. Arnold, Bend, OR (US); Dale M. Neubauer, Bend, OR (US)

(73) Assignee: THE ONWARD PROJECT, LLC, Bend, OR (US)

( * ) Notice: Subject to any disclaimer, the term of this patent is extended or adjusted under 35 U.S.C. 154(b) by 467 days.

(21) Appl. No.: 16/679,182

(22) Filed: Nov. 9, 2019

(65) Prior Publication Data

US 2021/0137756 A1 May 13, 2021

(51) Int. Cl.

| | |
|---|---|
| ***A61G 5/06*** | (2006.01) |
| ***A61G 5/10*** | (2006.01) |
| ***A61G 5/12*** | (2006.01) |

(52) U.S. Cl.

CPC ..... *A61G 5/06* (2013.01); *A61G 5/1051* (2016.11); *A61G 5/128* (2016.11)

(58) Field of Classification Search

CPC ..... A61G 5/06; A61G 5/1051; A61G 5/128
USPC ..... 280/657
See application file for complete search history.

(56) References Cited

U.S. PATENT DOCUMENTS 2,681,689 A * 6/1954 Breed ..... A61G 5/1094 280/848
3,917,312 A 11/1975 Rodaway
4,542,917 A 9/1985 Waite
4,549,624 A 10/1985 Doman
4,556,229 A 12/1985 Bihler et al.
4,641,850 A 2/1987 Rice et al.
4,861,056 A 8/1989 Duffy, Jr. et al.
4,892,323 A 1/1990 Oxford
4,926,777 A 5/1990 Davis, Jr.
5,020,818 A 6/1991 Oxford
5,137,102 A 8/1992 Houston, Sr. et al.
5,149,118 A 9/1992 Oxford
5,184,837 A 2/1993 Alexander
5,293,950 A 3/1994 Marliac
5,303,945 A 4/1994 Oxford
(Continued)

*Primary Examiner* — James A Shriver, II
*Assistant Examiner* — Hilary L Johns
(74) *Attorney, Agent, or Firm* — Aurora Consulting LLC; Ashley Sloat; David C. Cohen

(57) ABSTRACT

A convertible wheelchair system, between a wheelchair configuration and an all-terrain configuration, is provided. Embodiments include a central frame aligned along a central longitudinal axis, the central frame having a front and back bar parallel to each other and orthogonal to the central longitudinal axis, paired side bars aligned with the central longitudinal axis, and paired wheel cages, aligned with the central longitudinal axis and attached to the front and back bars, each wheel cage supporting an axle and a wheel mounted thereon. The system further includes a forward beam alignable with the central longitudinal axis, configured to support a forward wheel, and reversibly attached to the front bar. The convertible wheelchair is in the all-terrain configuration when the forward beam is attached to the frame, and the wheelchair configuration when the forward beam is detached from the frame, the central frame thereby standing without the forward beam.

17 Claims, 37 Drawing Sheets

(56) References Cited

U.S. PATENT DOCUMENTS 5,312,127 A * 5/1994 Oxford ..... A61G 5/1051 280/253
5,427,398 A 6/1995 Weybrecht
5,457,837 A 10/1995 Zuckerbrod
5,476,339 A 12/1995 Baranowski
5,507,513 A * 4/1996 Peters ..... A61G 5/00 280/250.1
5,513,716 A 5/1996 Kumar et al.
5,518,081 A 5/1996 Thibodeau
5,634,650 A 6/1997 Hensler, Sr.
5,669,619 A * 9/1997 Kim ..... A61G 5/045 301/5.1
5,681,049 A * 10/1997 Kim ..... A61G 5/045 280/250.1
5,820,294 A 10/1998 Baranowski
5,984,333 A 11/1999 Constantijn et al.
6,073,958 A 6/2000 Gagnon
6,076,619 A 6/2000 Hammer
6,241,321 B1 6/2001 Gagnon
6,644,426 B1 11/2003 Larue
6,805,209 B2 10/2004 Hedeen
6,805,371 B2 10/2004 Meginniss, III et al.
7,040,248 B1 5/2006 Whitfield
7,040,429 B2 5/2006 Molnar
7,165,750 B2 1/2007 Mccuskey et al.
7,192,043 B1 3/2007 McLuen
7,232,008 B2 6/2007 Levi et al.
7,735,847 B2 * 6/2010 Dougherty ..... A61G 5/1094 280/767
7,815,004 B1 10/2010 Watkins et al.
7,900,945 B1 3/2011 Rackley
7,921,954 B2 4/2011 Johnson et al.
8,123,245 B2 2/2012 Johnson et al.
8,132,637 B1 3/2012 Watkins et al.
8,152,192 B2 * 4/2012 Dougherty ..... A61G 5/1089 280/767
8,414,008 B2 * 4/2013 Hay ..... A61G 5/1083 280/250.1
8,561,736 B2 10/2013 Nelson et al.
8,678,402 B2 3/2014 Helterbrand
8,789,628 B2 7/2014 Swenson
8,905,421 B2 12/2014 Hansen et al.
8,973,925 B1 3/2015 Helterbrand
9,050,230 B2 6/2015 Fast et al.
9,072,641 B2 7/2015 Ewing
9,241,852 B2 1/2016 Dougherty et al.
9,289,338 B1 3/2016 Swenson
9,393,166 B2 7/2016 Albinmousa et al.
9,549,861 B2 1/2017 Kang et al.
9,662,251 B2 5/2017 Fertig et al.
9,855,173 B2 1/2018 Kennedy
9,950,733 B2 * 4/2018 Golden, Jr. ..... B62B 19/04
10,130,530 B2 * 11/2018 Golden, Jr. ..... A61G 5/104
2008/0315549 A1 12/2008 Dougherty
2009/0008902 A1 * 1/2009 Kylstra ..... A61G 5/027 280/304.1
2010/0109283 A1 5/2010 Wilmot et al.
2010/0237586 A1 * 9/2010 Dougherty ..... A61G 5/1089 280/304.1
2013/0009372 A1 1/2013 Willis
2015/0053490 A1 2/2015 Santagata
2018/0185209 A1 * 7/2018 Fontanesi ..... A61G 5/02
2019/0009629 A1 1/2019 Beylin et al.
2019/0151168 A1 * 5/2019 Jones ..... A61G 5/028

* cited by examiner

CONVERTIBLE WHEELCHAIR

TECHNICAL FIELD

This application is directed to wheelchair technologies, particularly related to wheelchairs capable of navigating uneven terrain.

BACKGROUND

Wheelchairs are extremely helpful for people with disabilities that limit their ability to ambulate and navigate through the world. Wheelchairs and their rider can be moved either through the effort of the wheelchair rider (by moving the wheels manually) or through the effort of an assisting person, typically pushing or controlling the wheelchair from a rear position. In spite of all the beneficial aspects of wheelchairs, challenges and impediments to movement remain. First, movement across a smooth, hard, and level surface is relatively easy, but any encountered slope (up or down) quickly erodes that level of ease. Further, regardless of slope, any unevenness of the surface, or surface softness that bogs down the wheels also erodes ease of movement. Second, to the extent that wheelchair movement force is supplied by the rider, any rider disability that affects the rider's strength or range of motion can likewise limit mobility in a wheelchair.

Because of these foregoing issues, wheelchair mobility is conventionally limited to indoor and outdoor spaces that are flat or only have mild slopes, and which are generally uncluttered and free of barriers and complications. However, the community of wheelchair riders is as deeply interested in getting out of the house and off-the-sidewalk as anyone else. Accordingly, there is a need and a market for wheelchairs that can provide disabled riders full access to the outdoors and wilderness trails.

SUMMARY OF THE TECHNOLOGY

A Convertible all-Terrain Wheelchair System

Embodiments of the invention are directed to a convertible wheelchair system that is convertible between a wheelchair configuration and an all-terrain configuration. Embodiments of the wheelchair system include a central frame aligned along a back-to-front central longitudinal axis; the central frame includes a front bar and a back bar parallel to each other and orthogonal to the central axis; paired side bars, each aligned with or parallel to the central axis; and paired wheel cages, each aligned with or parallel to the central axis and attached to the front and back bars.

Embodiments of the wheelchair system further include a forward beam alignable with the central longitudinal axis, the beam having a front end and a back end, wherein the front end of the forward beam is configured to support a forward wheel, and wherein the back end of the beam is configured to be attachable to and detachable from the front bar of the frame.

The convertible wheelchair is in the all-terrain configuration when the forward beam is attached to the frame. The convertible wheelchair is in the wheelchair configuration when the forward beam is detached from the frame, the central frame thereby standing without the forward beam. As used herein, "forward" refers to the position of the forward beam relative to the wheelchair when they are connected, per the all-terrain configuration. The forward beam, when connected, projects forward from the central frame of the wheelchair. When the forward beam and the central frame are connected to each other, they collectively form a full or complete all-terrain wheelchair frame.

Embodiments of a convertible wheelchair may further include a one or more tensioning line attachment sites on the central frame and/or on the forward beam. Some convertible wheelchair embodiments have a plurality of tensioning line attachment sites; each of these sites can anchor a tensioning force that is sufficient to exert control the movement of the chair. The tensioning force, per methods described herein, is exerted by a wheelchair crew member, and conveyed through a tensioning line to the tensioning line attachment site.

In one example, individual tensioning line attachment sites on the central frame are arranged to attach to a tensioning line that can apply tensioning force in a range of directions, said directions comprising any one or more of a forward pulling tension, a lateral pulling tension, or a rearward pulling tension. In another example, individual tensioning line attachment sites on the forward beam are arranged to attach to a tensioning line that can apply tensioning force in a range of directions, said directions comprising any one or more of a forward pulling tension, a lateral pulling tension, or a rearward pulling tension.

Some embodiments of the convertible wheelchair further included one or more tensioning lines, each of the one or more tensioning lines has a proximal end and a distal end. In this embodiment, each of the one or more tensioning lines has a proximal end attached to the convertible wheelchair, and a free distal end which can be controlled by a wheelchair movement control crew member. In some embodiments of the tensioning line, the distal end (controlled by a crew member) is connected to a waist belt or harness to be worn by the crew member.

In some embodiments, at least one of the one or more tensioning lines includes a flexible material, for example, fabric or leather. In some embodiments, at least one of the one or more tensioning lines includes a stiff material, for example, fiberglass.

In some embodiments of the convertible wheelchair, the forward beam has a non-circular cross-sectional profile, for example, a rectangular or a square cross-sectional profile.

In some embodiments of the convertible wheelchair, when the forward beam is attached to the frame according to the all-terrain configuration, it is disposed at an angle $\alpha$ relative to a ground surface upon which the wheelchair is resting. The tensioning line attached to the front end of the forward beam, when being pulled by a crew member, forms an angle relative to the ground surface that is substantially aligned with angle $\alpha$, which typically ranges between 10°-20°. In some embodiments, angle $\alpha$, is approximately 15°.

In some embodiments of the convertible wheelchair, the forward wheel is mounted on the forward beam by a trailing link type of suspension. In some embodiments, the forward wheel has a 360 degree rotatability. An operational advantage of the trailing link suspension and the free-rotatability (through 360 degrees) of the forward wheel is that the forward wheel easily deflects from an obstacle encountered on the ground surface, thus mitigating force of an impact that would otherwise occur.

Some embodiments of the convertible wheelchair further include a forward bar supported by the front bar of the central frame and positioned parallel thereto, the forward bar providing support for a pair of caster wheels (left and right) and a footrest. In some of these embodiments, the paired caster wheels and the footrest are rotatable on the forward bar, independently of each other. In some of these embodiments, the footrest is supported from the forward bar by footrest support arms having a telescopically adjustable length, the adjustable length thereby providing an adjustable distance between the forward bar and the footrest.

In some embodiments of the convertible wheelchair, each of the paired wheel cages has an exterior rail, a clevis arch, and inner rail that also serves as a side bar of the central frame, a buttress extending between the exterior rail and the clevis arch. In some embodiments of the paired wheel cages, each buttress has a lifting site configured to facilitate lifting of the wheelchair by a crew member, wherein the lifting site is substantially horizontal with respect to a ground surface upon which the wheelchair is resting or positioned.

Some embodiments of the convertible wheelchair include an axle supported within each wheel cage. Some embodiments of the convertible wheelchair further include a pair of rear wheels (left and right), each wheel supported individually on one of a pair of axles, each axle supported within one of the pair of wheel cages. In some embodiments of the wheel cages and supported wheel axles, each of the axles are positioned in the wheel cage at a camber of between about 1° to about 9° downward from a horizontal alignment. A wheel mounted on a downwardly aligned axle tilts inward, the surface contacting portion of a wheel being further external than the upper portion of the wheel. In particular embodiments, each of the axles are positioned in the wheel cage at a camber of about 5° downward from a horizontal alignment.

Some embodiments of the convertible wheelchair further include a steering column supported by the rear bar of the central frame, the steering column projecting upward and supporting a steering bar. In some embodiments, the steering column is configured to be of adjustable height.

Some embodiments of the convertible wheelchair further include a seat mounting assembly mounted on paired support bars disposed between the back and front bars of the central frame, the seating mounting assembly having paired sides and a seat-supporting platform disposed between the paired sides.

In some seat mounting assembly embodiments, the paired sides are back-forward adjustable on the parallel support bars, and the seat platform is adjustable with regard to its angle relative to the support bars. In some seat mounting assembly embodiments, a seat is mounted on the seat platform, and the back-forward position of the seat with respect to the seat platform is adjustable.

In particular embodiments, the seat mounting assembly is configured to be able to accommodate seats of varying size to accommodate riders of varying size, for example, seats of small, medium, and large size may be accommodated and switched in and out easily.

A Three-Wheeled all-Terrain Wheelchair

Embodiments of the invention also include a three-wheeled all-terrain wheelchair having a full wheelchair frame aligned along a central longitudinal axis, the full frame including a central frame and a forward beam fixedly connected together. The central frame includes a front bar and a back bar parallel to each other and orthogonal to the central longitudinal axis, a forward front bar (in front of- and parallel to the front bar), paired side bars (each aligned with the central longitudinal axis), and paired wheel cages, each wheel cage aligned in parallel with the central longitudinal axis and attached to the front and back bars of the frame, and each configured to support a rear wheel. The forward beam is aligned with the central longitudinal axis, and includes a front end and a back end. The front end of the forward beam is configured to support a forward wheel, and the back end of the forward beam is connected to the central frame. In some embodiments, the connection of the forward beam and the central frame includes an arrangement whereby the forward beam is connected to both the front bar and the forward front bar of the wheelchair frame.

A Method of Controlling Movement of an all-Terrain Wheelchair

Embodiments of the invention are also directed to a method of controlling movement (or contributing to controlling movement) of embodiments of a convertible wheelchair, particularly in its all-terrain configuration. The convertible wheelchair is particularly designed and configured for wheelchair crew members to engage in controlling movement of the wheelchair in various ways, as summarized below.

The all-terrain configuration of the convertible wheelchair has a central frame, a pair of back wheels, a forward wheel mounted on a forward beam connected to the frame, a plurality of tensioning line attachment sites attached to the frame, and one or more tensioning lines attached to one of the tensioning line attachment sites. The central frame and the forward beam collectively form a full all-terrain wheelchair frame.

The method of controlling movement of the convertible wheelchair includes providing a wheelchair movement crew of one or more members; attaching a distal end of a tensioning line to a tensioning line attachment site on the central frame of the convertible wheelchair or on the forward beam; and applying tension to the distal end of the tensioning line, one of the crew members exerting the tension. Accordingly, the crew, collectively, thereby controls (or contributes to controlling) movement of the convertible wheelchair.

In some embodiments of the method, controlling movement of the convertible wheelchair in the all-terrain configuration includes pulling the wheelchair forward. In some embodiments of the method, controlling movement of the convertible wheelchair in the all-terrain configuration includes constraining or preventing unwanted lateral movement of the wheelchair. In some embodiments of the method, controlling movement of the convertible wheelchair in the all-terrain configuration includes constraining or preventing unwanted forward movement of the wheelchair.

In some embodiments of the method, movement crew members may include varying numbers at various respective positions, these positions including any one or more of forward of the wheelchair, lateral to the wheelchair, or behind the wheelchair.

In some embodiments of the method, multiple tensioning lines are attached, individually, to multiple tensioning line attachment sites on the convertible wheelchair, and a member of the crew of multiple crew members is assigned to a tensioning line, the method thus comprising each crew member applying tension to his or her respective tensioning line, the multiple crew members thereby controlling the movement of the convertible wheelchair.

In some embodiments of the method, the all-terrain wheelchair comprises a steering column attached to a rear aspect of the central frame, the method further comprising assigning a crew member to control movement of the wheelchair by way of the steering column. The method includes controlling movement of the wheelchair by way of the steering column.

In another method of controlling movement of a convertible wheelchair in an all-terrain configuration, the all-terrain configuration comprising a central frame, a pair of back wheels, a forward wheel mounted on a forward beam connected to the frame, and a rear-mounted steering column, the method includes assigning one member of a crew to assume a position behind the steering column; and that member of the crew controlling movement of the convertible wheelchair by applying force to the wheelchair. The wheelchair-moving force includes any one or more of forward-directed force, forward movement braking force, or lateral force.

BRIEF DESCRIPTION OF THE FIGURES

FIG. 6A shows front perspective view of the convertible wheelchair in the low-profile configuration.

FIG. 6B shows side view of the convertible wheelchair in the low-profile configuration.

FIG. 7D shows the forward wheel in a reverse orientation, such orientation suitable for attaching the forward beam to the wheelchair, the caster wheels contacting the ground.

FIG. 7E shows the forward wheel in a trailing arm orientation, such orientation lifting the caster wheels off the ground.

FIG. 9A shows a view of a seat in an aft position (within a range of forward-aft optional positions) on the seat mount assembly, which includes support rails, sides, and angled seat platform.

FIGS. 9B-9D show the seat positioned at various angles. FIG. 9B shows the seat at a horizontal angle.

FIG. 9C shows the seat at a moderate incline angle.

FIG. 9D shows the seat at the fully inclined angle.

FIG. 10A is a front perspective view of a wheelchair footrest and caster wheels; the larger context into which the footrest is disposed may be seen in any of FIG. 1A, 1B, or 2B.

FIG. 10B shows a front perspective view of a wheelchair embodiment, with the footrest and caster wheels in a fully down (and rearward rotated) position, this position allowing an unimpeded entry for a rider to become situated into the wheelchair.

FIG. 10C shows a side view of a wheelchair embodiment, with the footrest and caster wheels in a fully down (and rearward rotated) position (as in FIG. 10B).

FIG. 10D shows a side view of a wheelchair embodiment with the footrest in two height positions, the rotational angle of the footrest being held constant.

FIG. 10E shows a side view of a convertible wheelchair embodiment (in a wheelchair configuration), with the footrest in a normal mid-range rotated position for supporting a rider's feet when the convertible wheelchair is in a wheelchair configuration, and further showing the caster wheels in a mid-range rotated position, also appropriate in the wheelchair configuration.

FIG. 10F shows a side view of a convertible wheelchair (in an all-terrain configuration), with both the footrest and the caster wheels in a fully forward rotated position, this position maximizing the ground clearing space in the central longitudinal space underneath the wheelchair.

FIG. 11A shows the steering column in a fully raised position.

FIG. 11B shows the steering column in a fully lowered position.

FIG. 12A is an upper perspective view.

FIG. 12B is a top view of the disc brake mounting bracket.

FIG. 15A shows a rear view of a wheelchair in an all-terrain configuration on a surface sloping to the right as it is being secured by tensioning lines on the left side of the chair.

FIG. 15B shows a rear view of a wheelchair in an all-terrain configuration on a surface sloping to the left as it is being secured by tensioning lines on the right side of the chair.

FIG. 16A shows the full length of the tensioning line, from its proximal end (attached to a tensioning line attachment site) to its distal end, which may be attached to a waist belt to be worn by a crew member.

FIG. 16B shows a detail view of the proximal end of the tensioning line and its attachment to an attachment site on the forward beam.

FIG. 16C shows a detail view of the distal end of the tensioning line and its attachment to a waist belt.

FIG. 17A shows the tensioning line, in full, from its proximal end to its distal end, to be held by a crew member when controlling the wheelchair.

FIG. 17B shows a detail view of the proximal end of the tensioning line to a tensioning line attachment site on the frame of the wheelchair.

DETAILED DESCRIPTION

Figure 1A:
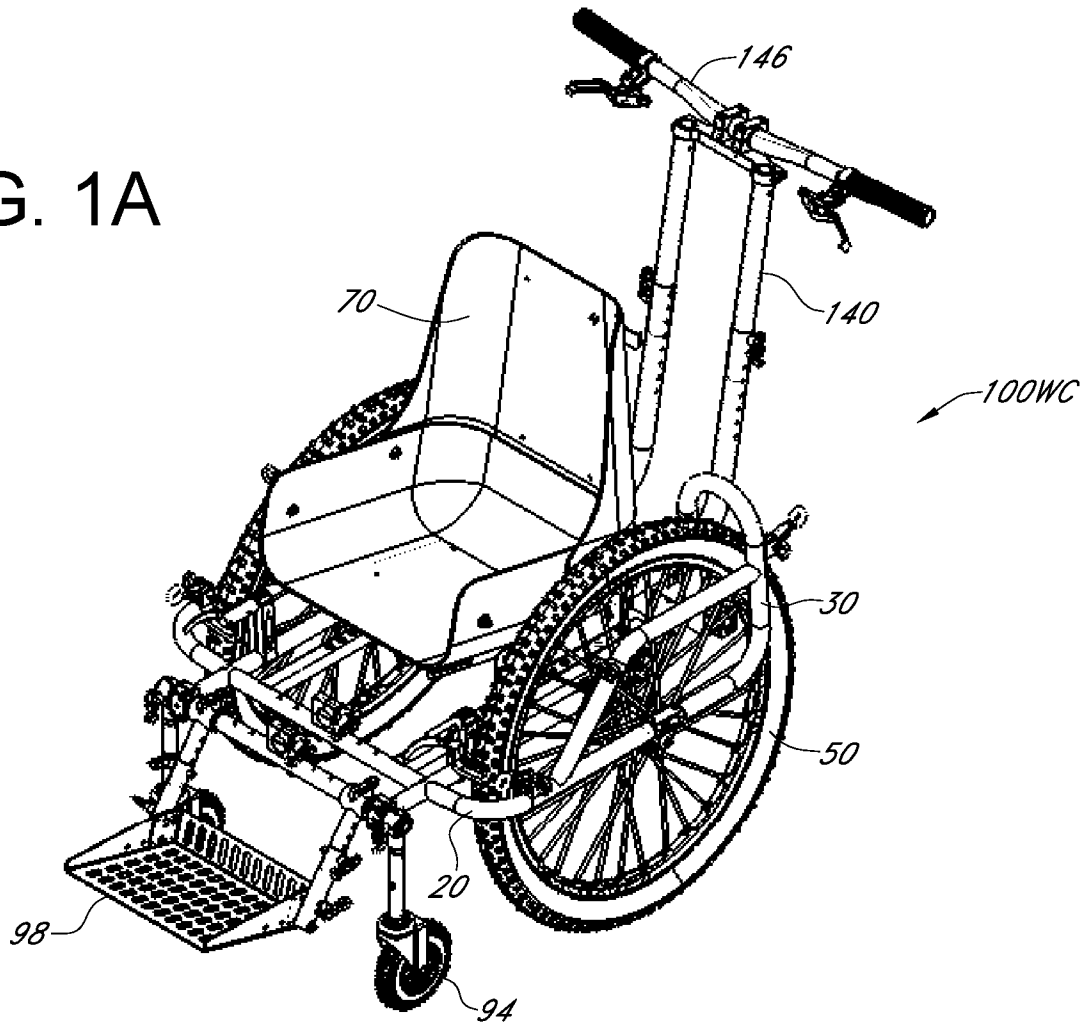
FIG. 1A shows a perspective view of a convertible wheelchair embodiment in a wheelchair configuration.
Figure 1B:
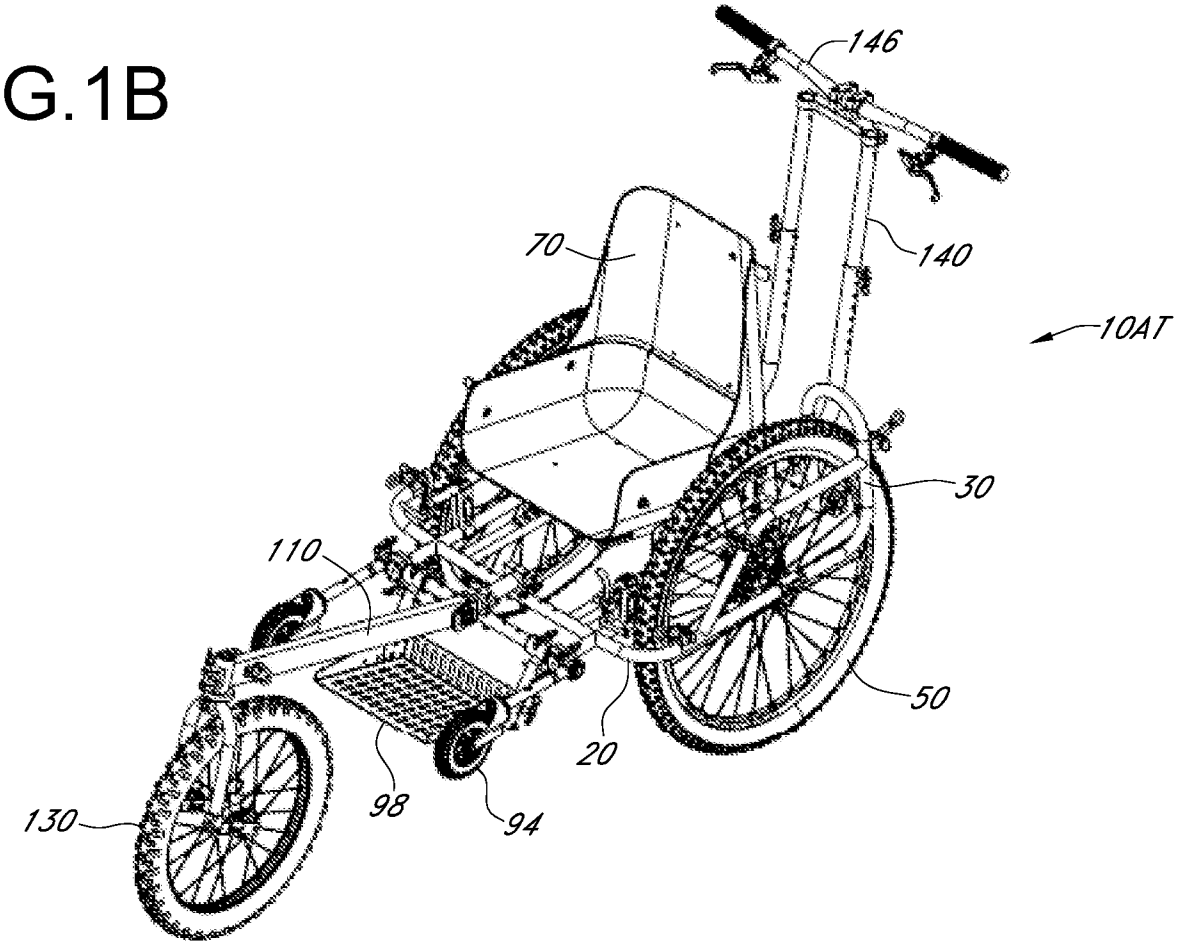
FIG. 1B shows a perspective view of a convertible wheelchair embodiment in an all-terrain configuration.

FIGS. 1A-1B show perspective views of a convertible wheelchair embodiment in a wheelchair configuration 10-WC (FIG. 1A) and in an all-terrain 10-AT configuration (FIG. 1B), respectively. All terrain configuration wheelchair 10-AT includes the wheelchair 10-WC, itself, and an attached forward beam 110, which supports a forward wheel 130.

A convertible wheelchair as provided (configurations 10-WC and 10-AT, collectively) is particularly suitable and appropriate for a wheelchair rider that is compromised in upper body strength, flexibility, or any condition that makes it difficult for them to handle a chair in a conventional manner (as by manually rotating the main wheel set, and self-propelling the chair). A convertible wheelchair is also appropriate for a rider who is temporarily compromised, as by an injury, for example. A convertible wheelchair is further suitable for a rider who is fully able with regard to upper body strength, but who is addressing a challenging travel surface, where self-propelling by manually turning wheels is insufficient or unsafe.

Convertible wheelchair in the wheelchair configuration 10-WC is suitable for riding surfaces that are generally smooth, flat, and uncomplicated. Convertible wheelchair in the all-terrain configuration 10-AT is particularly suitable for movement over challenging travel surfaces, whether in the city or on a trail. Wheelchair 10-AT is particularly adapted for the participation of crew members in moving the wheelchair, as described further below.

Figure 2A:
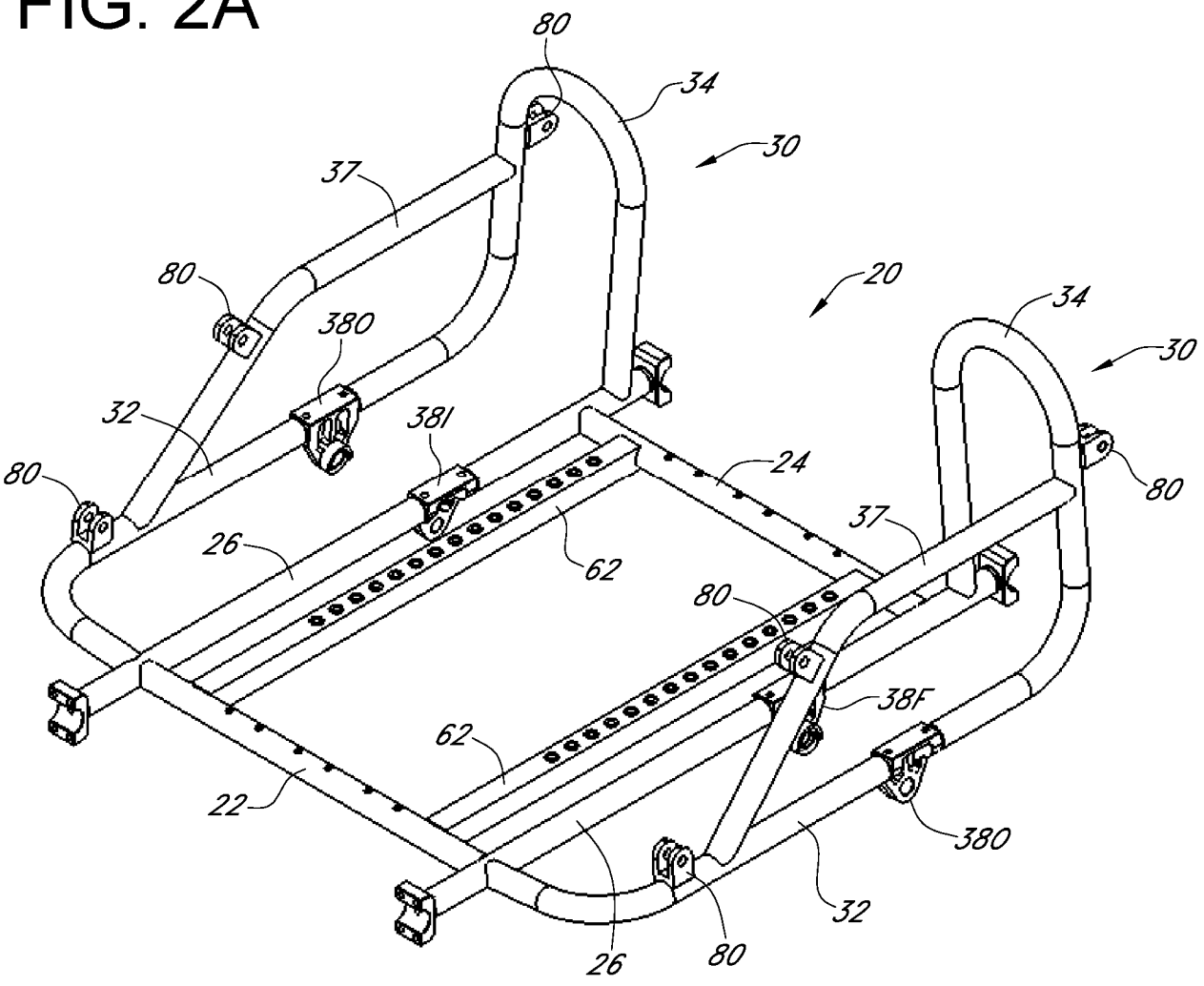
FIG. 2A shows a perspective view of a central frame of a convertible wheelchair embodiment, showing, in particular, front, back, and side bars, wheel cages, and tensioning line attachment sites.

FIG. 2A shows a perspective view of a central frame 20 of a convertible wheelchair embodiment, showing, in particular, a front bar 22, a back bar 24, two side bars 26, two wheel cages 30, and multiple tensioning line attachment sites 80 attached to central frame 20. Wheel cages 30 include an exterior rail 32, a clevis arch portion 34, a buttress 36 connecting the exterior rail and the clevis arch portions. Sidebars 26 serve as an interior rail of wheel cage 30. Buttress 36 includes a horizontal handrail section 37, that provides an ergonomic site for lifting the chair. Seat assembly support rails 62 serve dual purposes of strengthening central frame 20 as well as supporting the seat (see FIGS. 9A-9D). Axle dropout sites 38E (exterior of the wheel cage) and 38I (inside the wheel cage) are disposed, respectively, on exterior rail 32 and side bar 26 (also identified as a wheel cage interior rail) 26 of each wheel cage 30. These axle dropout sites are shown in greater detail in FIGS. 8A-8B.

Figure 2B:
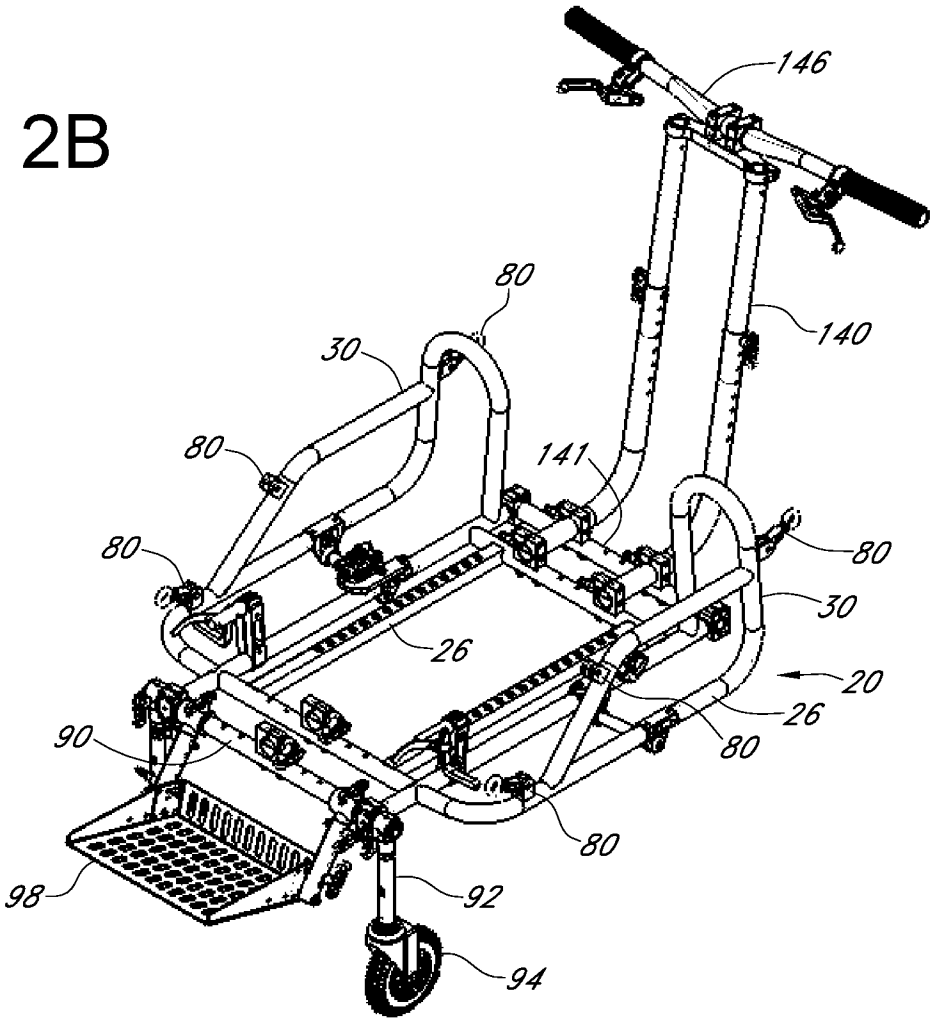
FIG. 2B shows a perspective view of a central frame of a convertible wheelchair embodiment (as in FIG. 2A) with the addition of a forward front bar that supports caster wheels and a footrest, and a rear steering column.

FIG. 2B shows a perspective view of a central frame 20 of a convertible wheelchair embodiment 10 (as in FIG. 2A) with the addition (on the forward end) of a forward front bar 90 that supports caster wheels 94 and a footrest 98. At the rear, a rear-mounted steering column 140 is situated, and steering column base bar 141, attached to central frame components and parallel to back bar 24.

Figure 2C:
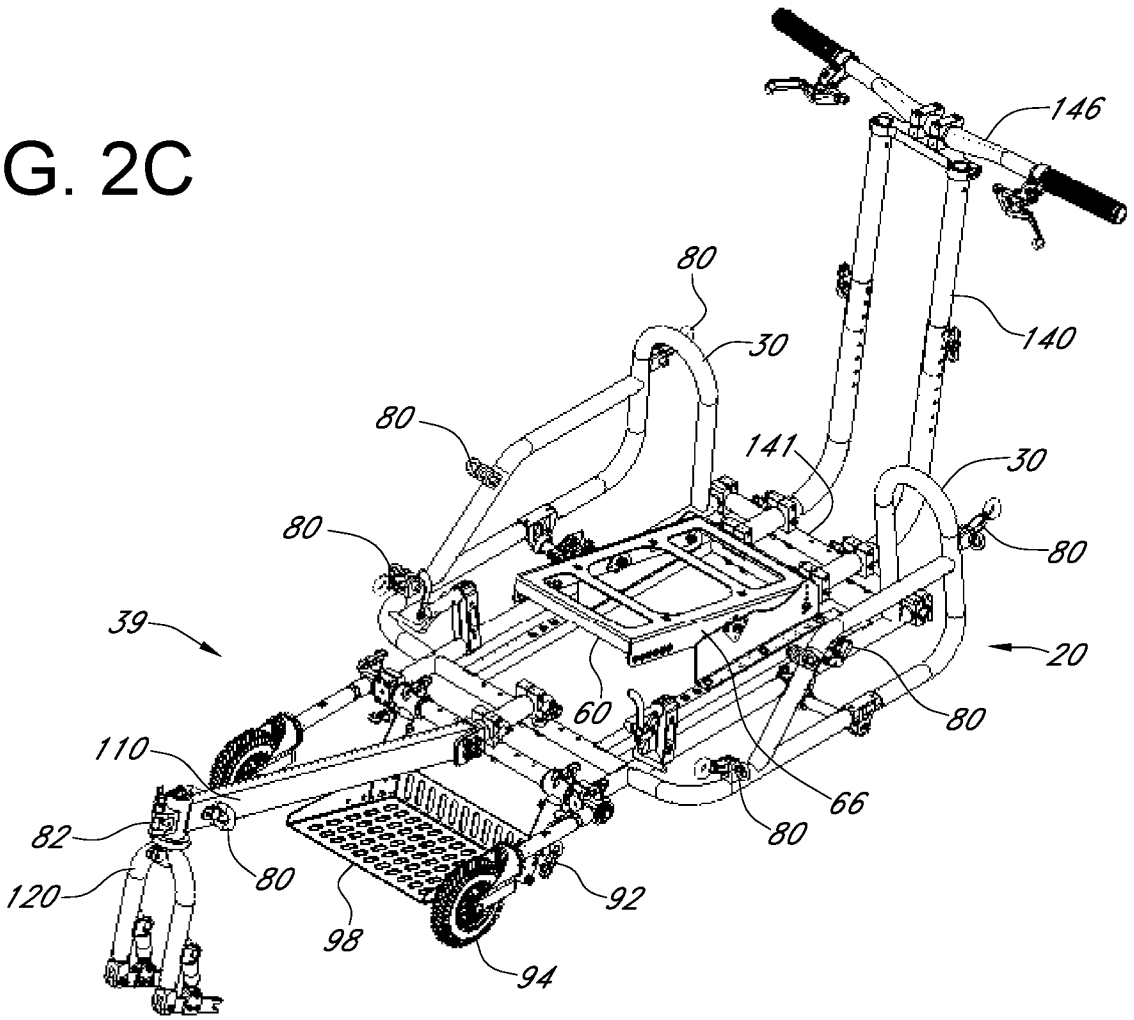
FIG. 2C shows a perspective view of a full frame of a convertible wheelchair embodiment in an all-terrain configuration, the full frame including the central frame and a forward beam connected together.

FIG. 2C shows a perspective view of a full frame 39 of a convertible wheelchair embodiment in an all-terrain configuration, the full frame includes central frame 20 and a forward beam 110 connected together. More generally, FIG. 2C shows a perspective view of a central frame 20 of a convertible wheelchair embodiment with forward and rear features (as in FIG. 2B) with the addition of a chair platform 66 and a forward beam 110. The combined structure of central frame 20 and forward beam 110 may be understood to constitute the full frame 39 of an all-terrain wheelchair embodiment 10AT. FIG. 2C also shows seat assembly 60 and angled seat platform 66, as shown in greater detail in FIG. 9A.

Figure 15B:
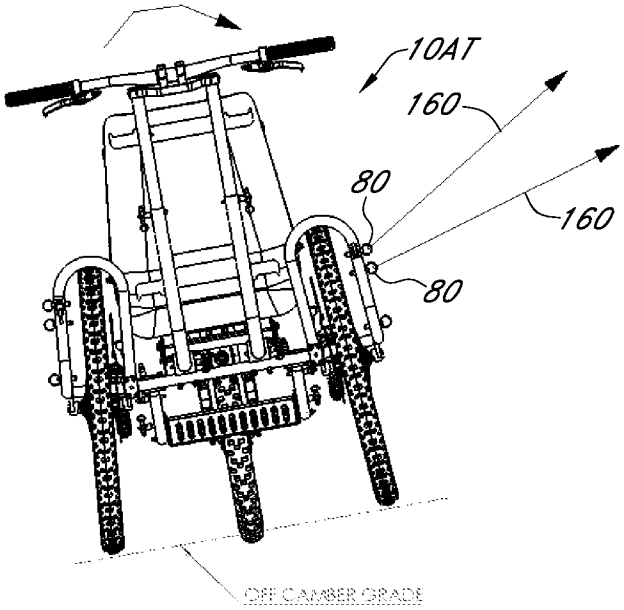
FIGS. 15A-15B show lateral-pulling tensioning lines.
Figure 15A:
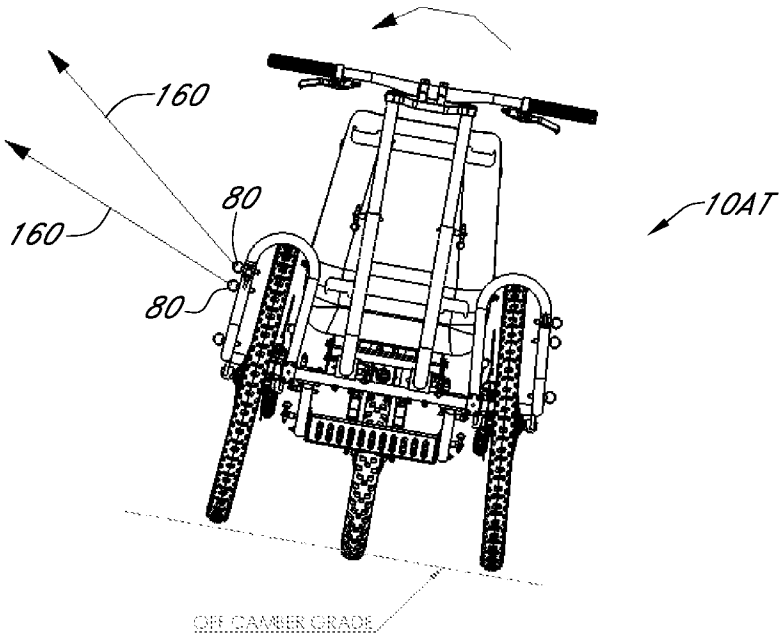
Figure 16B:
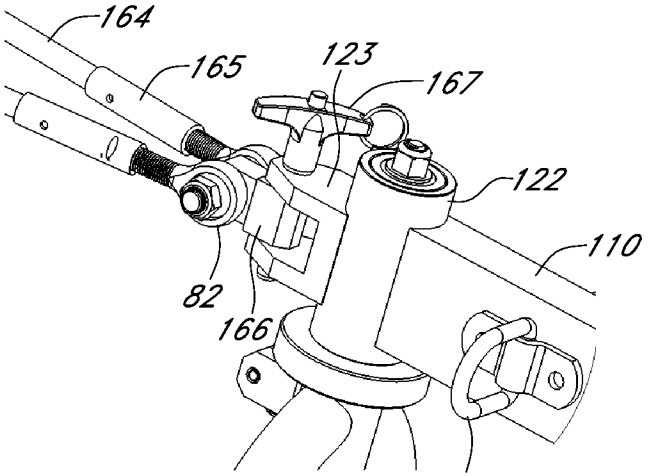
FIGS. 16A-16C show aspects of a tensioning line embodiment and its attachment to an attachment site on the forward beam.

Tensioning line attachment sites 80 and 82 are also disposed on the forward beam 110; see FIG. 16B). The multiple tensioning line attachment sites 80 that are depicted extensively (in particular, see FIGS. 7A, 7C, 9A, 13A, and 13B) and described in detail further below. These tensioning line attachment sites have an important role in the methods of moving a wheelchair 10-AT, as assisted by one or more crew members by way of operating tensioning lines, as depicted (FIGS. 15A-15B, 18A-18D) and described further below.

Figure 3A:
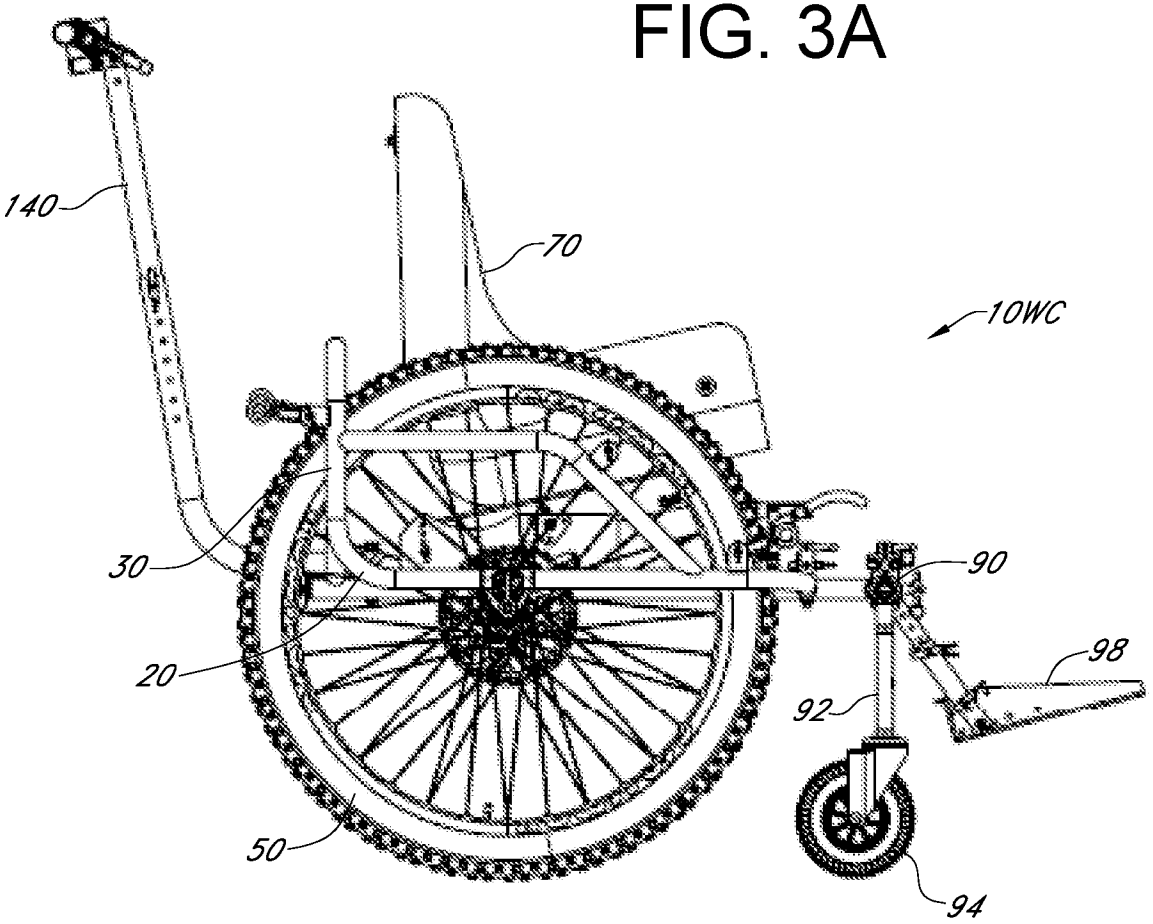
FIG. 3A shows a side view of an embodiment of a convertible wheelchair in a wheelchair configuration.
Figure 3B:
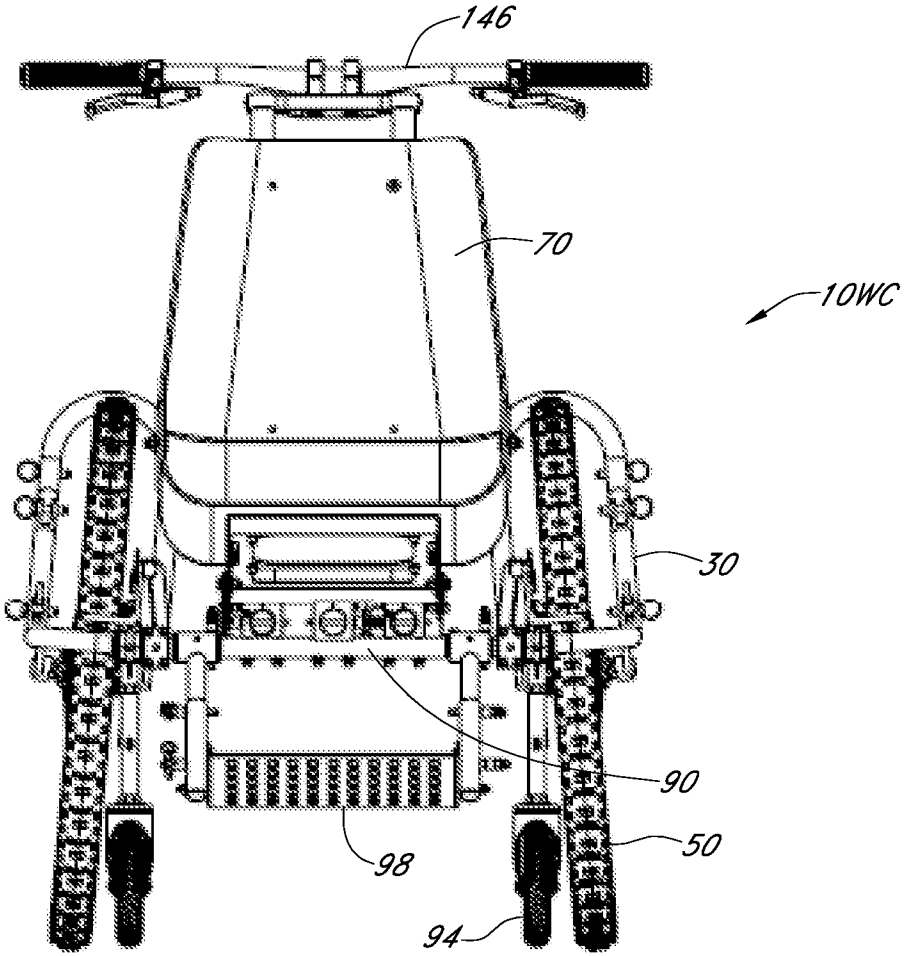
FIG. 3B shows a front view of an embodiment of a convertible wheelchair in a wheelchair configuration.
Figure 3C:
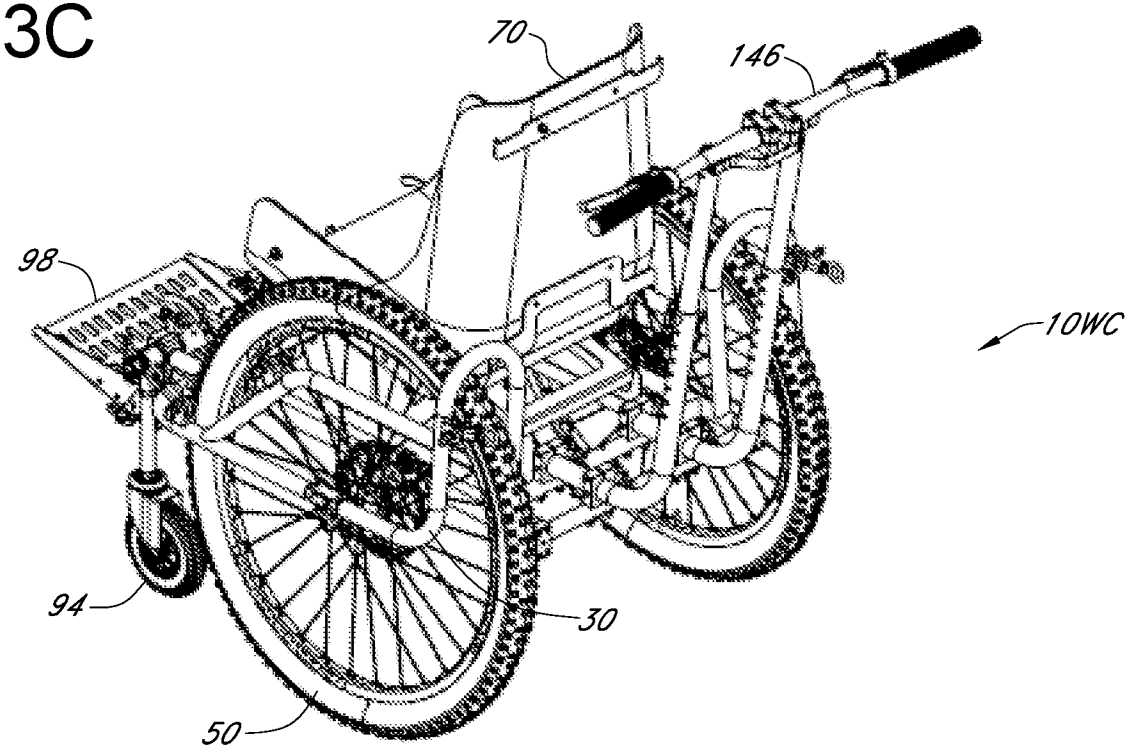
FIG. 3C shows an upper rear perspective view of an embodiment of a convertible wheelchair in a wheelchair configuration.

FIG. 3A-3C show various views of an embodiment of a convertible wheelchair in a wheelchair configuration 10-WC, which includes central frame 20, wheel cages 30, wheels 50, and steering column 140. FIG. 3A shows a side view, FIG. 3B shows a front view, and FIG. 3C shows an upper rear perspective view. FIG. 1A, described above, provides a companion upper front perspective view.

Figure 4A:
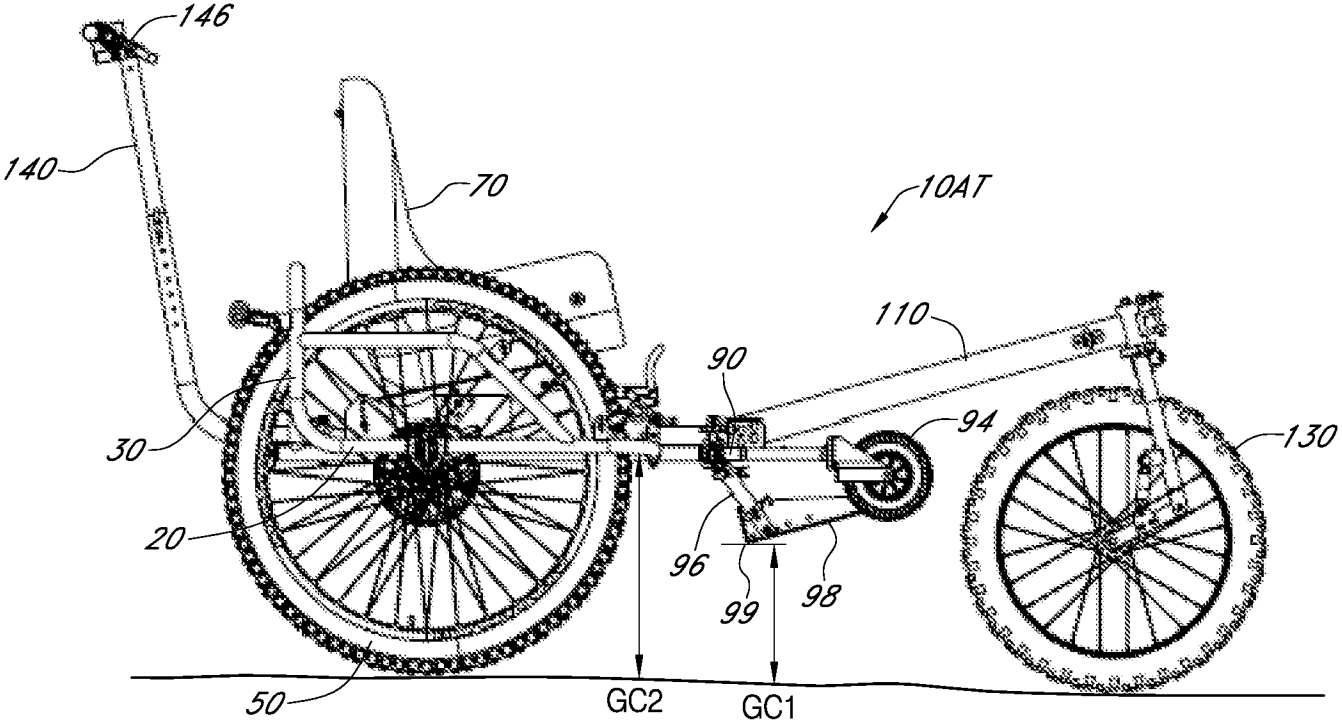
FIG. 4A shows a side view of an embodiment of a convertible wheelchair in an all-terrain configuration.
Figure 4B:
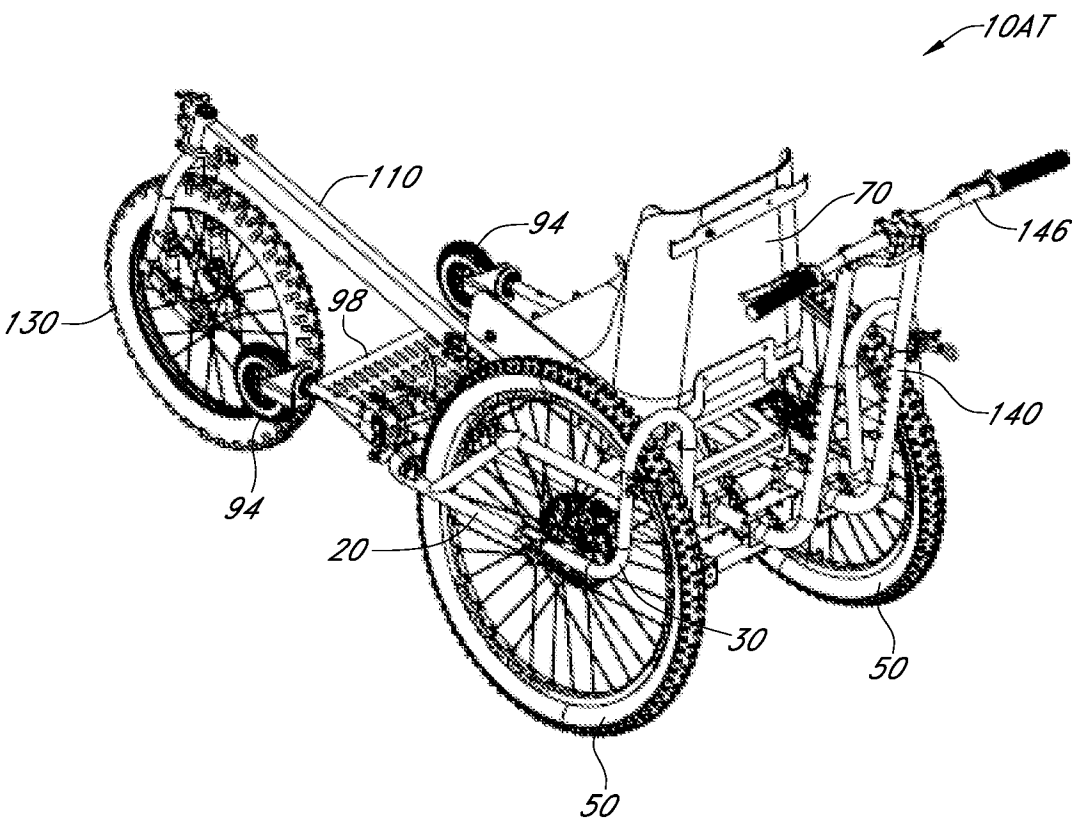
FIG. 4B shows an upper rear perspective view of an embodiment of a convertible wheelchair in an all-terrain configuration.
Figure 4C:
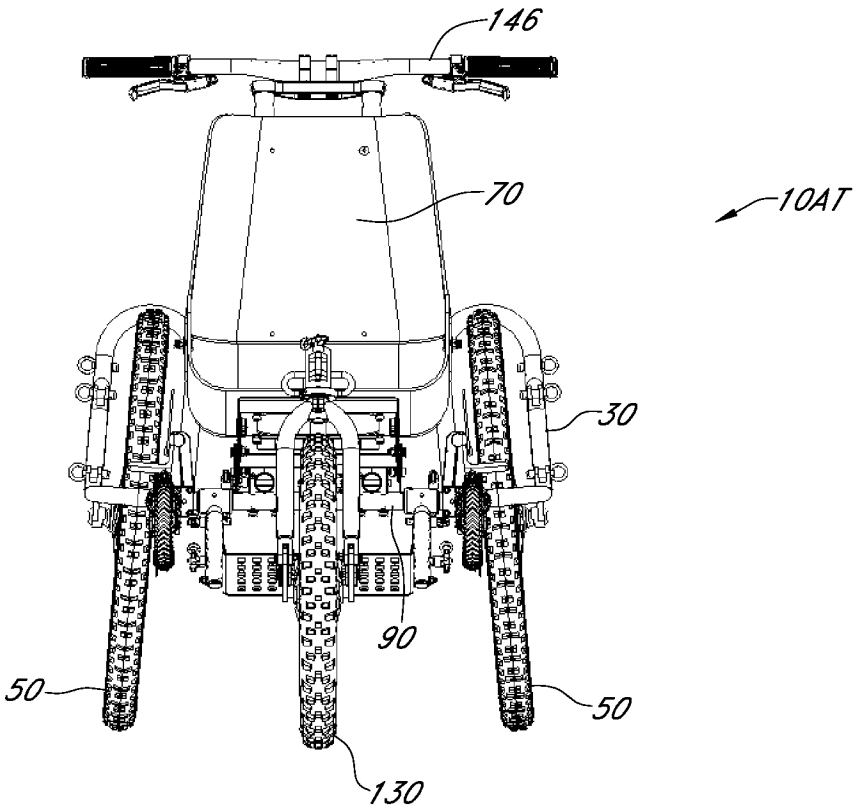
FIG. 4C shows a front view of an embodiment of a convertible wheelchair in an all-terrain configuration.

FIG. 4A-4C show views of an embodiment of a convertible wheelchair in an all-terrain configuration 10-AT, which includes central frame 20, and forward beam 110. A convertible wheelchair (10-WC and 10-AT) also includes wheels 50, and steering column 140. Also shown are rear wheels 50, mounted within wheel cages 30, and forward wheel 130, mounted on forward beam 110. FIG. 4A shows a side view and FIG. 4B shows an upper rear perspective view. FIG. 1B, described above, provides a companion upper front perspective view of wheelchair 10-AT.

FIG. 4A shows a side view of an embodiment of a convertible wheelchair in an all-terrain configuration 10-AT. Notably, in this view, it can be seen that footrest 98 and caster wheels 96 are rotated up and forward of forward front bar 90, this being appropriate for all-terrain navigation, keeping ground clearance at a maximum level.

FIG. 4B shows an upper rear perspective view of an embodiment of a convertible wheelchair in an all-terrain configuration 10-AT. It is by attachment of forward beam 110 to central frame 20, that the convertible wheelchair assumes an all-terrain configuration 10-AT.

FIG. 4C shows a front view of an embodiment of a convertible wheelchair in an all-terrain configuration 10-AT. This view is understandably quite similar to the front view of wheelchair 10-WC (the wheelchair configuration) in FIG. 3B, except for the visible presence of front wheel 130.

Ground clearance under a wheelchair is an important feature for wheelchairs, particularly all-terrain wheelchairs; in general, a high ground clearance is advantageous for wheelchair operation. FIG. 4A provides a view of aspects of ground clearance elevation or height in all-terrain wheelchair configuration 10-AT. As shown, footrest 98 is shown in a fully retracted position, retraction being allowed by a telescoping feature of footrest support arms 96. (This feature of footrest 98 and footrest support arms 96 is shown in detail in FIGS. 10A and 10D.) In this view (FIG. 4A), footrest 98 is also shown as being maximally forward rotated towards forward front bar 90. Caster wheels are also shown fully rotated forward toward forward front bar 90.

It can be seen in FIG. 4A that the rearmost corner 99 of footrest 98 is the lowest structure in the central section (under forward beam 110) of wheelchair 10-AT; this site is labeled as GC1. In one example, footrest 98 is positioned at 8.75 inches above ground level. Accordingly, per this example, it may be understood that the ground clearance height at this site GC1 is at least 8.75 inches, 8.5 inches or greater. Under the main body of the wheelchair portion of wheelchair 10-AT (as well as wheelchair 10-WC), the central, longitudinally aligned ground clearance is determined by the elevation of central frame 20 and forward front bar 90. In one particular example, central frame 20 and forward front bar 90 are positioned at 14.75 inches above ground level; this site is labeled GC2. Accordingly, per this example, it may be understood that that the ground clearance height at this site GC2 is at least 14.75 inches, or 14.50 inches or greater.

Figure 5A:
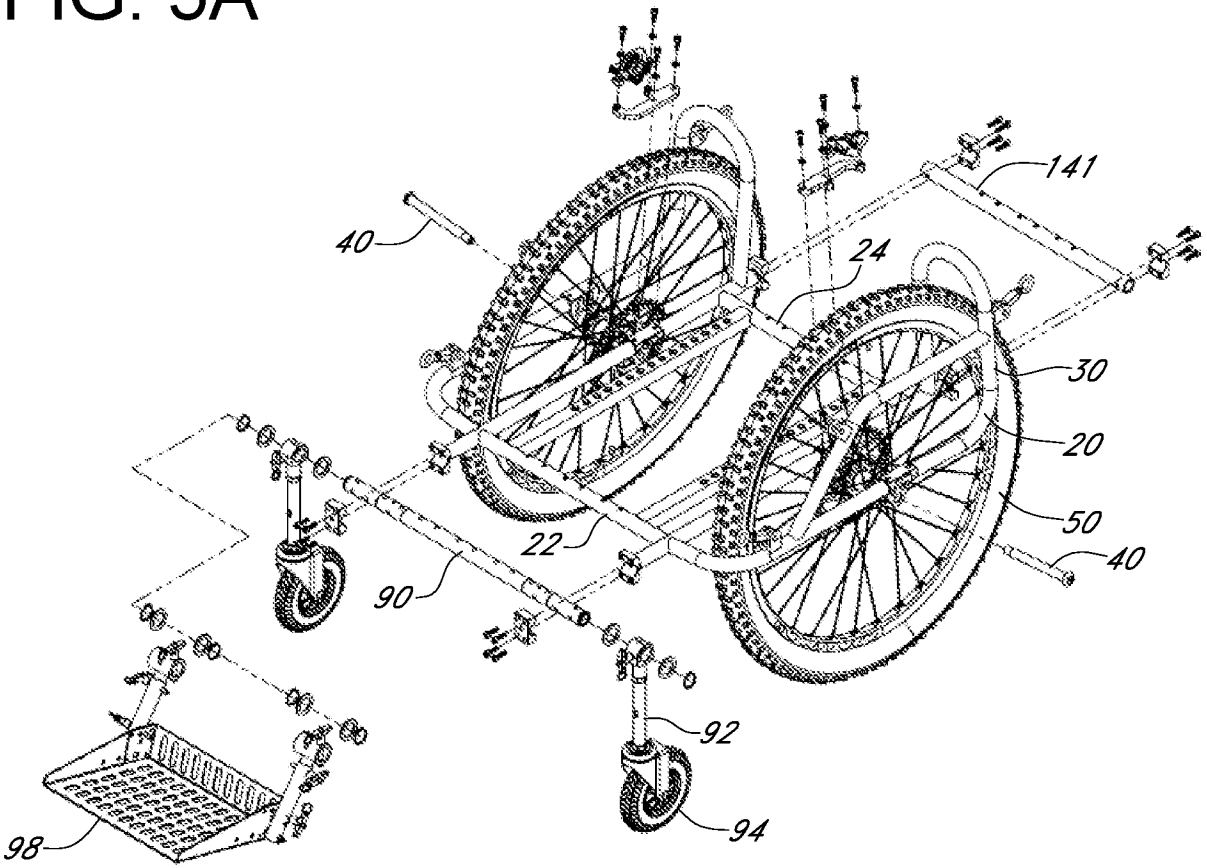
FIG. 5A shows an exploded view of elements of the frame of an embodiment of a convertible wheelchair in a wheelchair configuration, with a focus on front-end structural details.
Figure 5B:
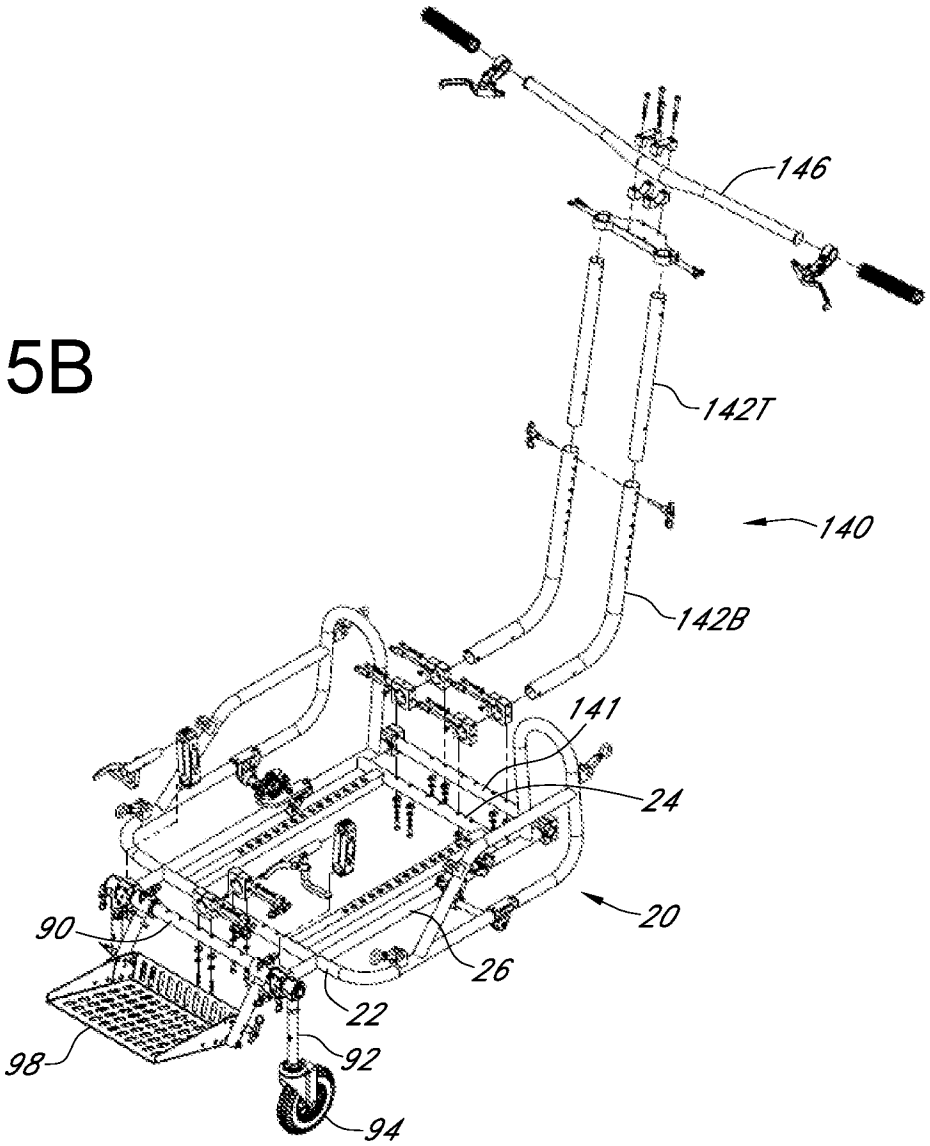
FIG. 5B shows an exploded view of elements of the frame of an embodiment of a convertible wheelchair in a wheelchair configuration, with a focus on back-end structural details.

FIGS. 5A and 5B show two exploded front perspective views of elements of the central frame 20 of convertible wheelchair in a wheelchair configuration 10-WC. FIG. 5A provides a focus on front-end structural components; FIG. 5B provides a focus on focus on back-end structural components.

FIG. 5A shows front-end structural details of central frame 20 (as seen in FIGS. 2A-2C) and their various connection arrangements. The main components include central frame 20, the frame's component front bar 22, back bar 24, side bars 26, and wheel cages 30. Supported by forward front bar 90 are caster wheels 94 and footrest 98. Further shown are rear wheels 50, and steering column base bar 141.

FIG. 5B (focusing on back-end structure of 10-WC, and omitting rear wheels 50 for clarity) has caster wheels 94 and footrest 98 attached to forward front bar 90, the forward front bar positioned parallel to rear bar 24 of central frame 20.

Steering column base bar 141 is shown attached to the rear-most portions of sidebars 26 and positioned parallel to rear bar 141 of central frame 20. Shown in exploded detail are steering column component support posts 142, including steering column base portions 142B and top portions 142T. The steering column's top cross bar is disposed atop the paired top portions 142T.

Figure 6A:
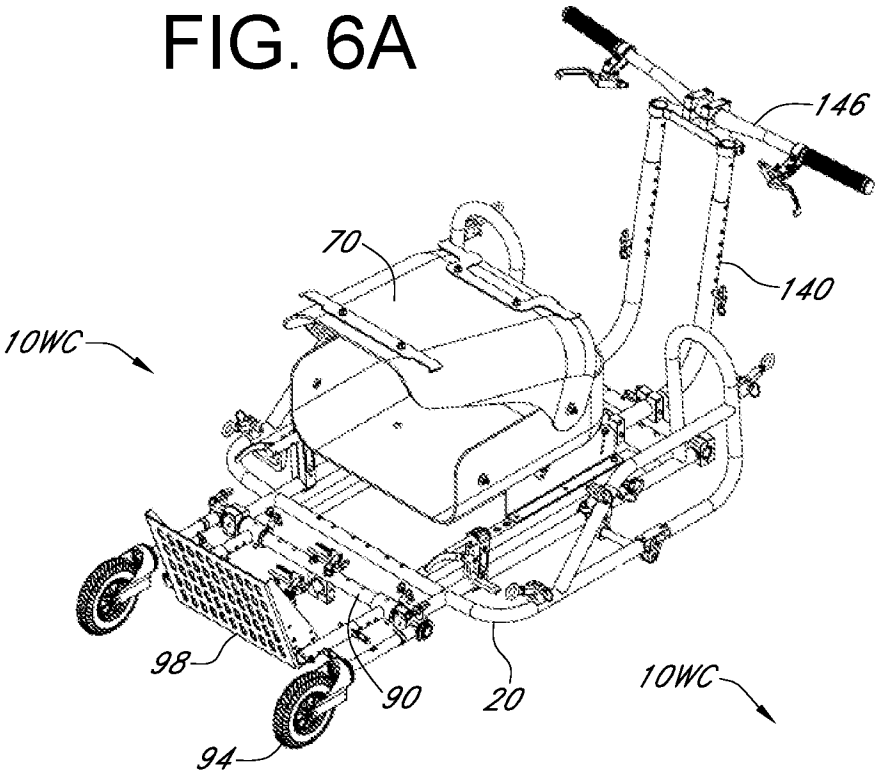
FIGS. 6A-6B show views of an embodiment of a convertible wheelchair in a low-profile configuration, with the seat at minimal height and folded forward, rear wheels removed, and the steering column height adjusted to its minimal height.
Figure 6B:
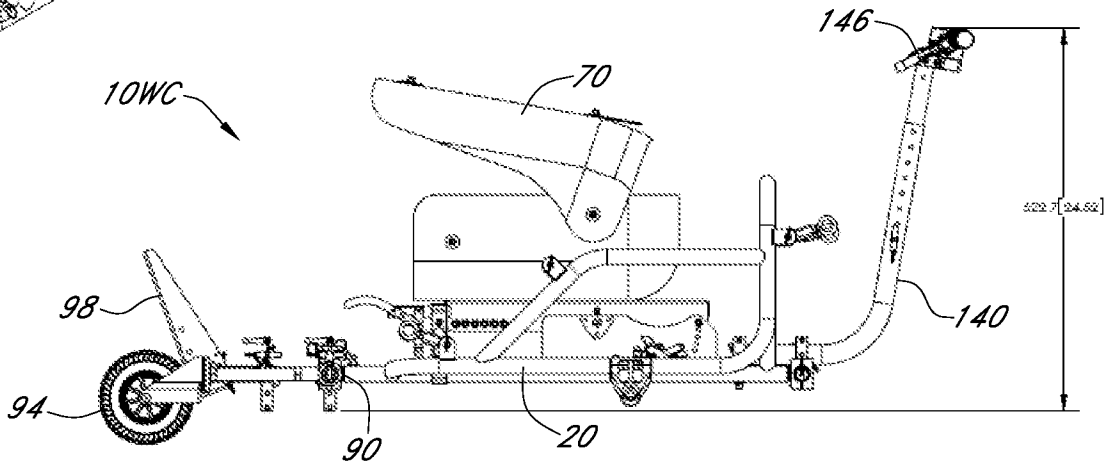

FIGS. 6A-6B show views of an embodiment of a convertible wheelchair 10-WC in a low-profile configuration, with the seat at minimal height and folded forward, and the steering column height adjusted down to its minimal height, and the back wheels removed A low-profile configuration is useful when transporting convertible wheelchair 10-WC, or storing in a storage site. FIG. 6A shows a front perspective view of the convertible wheelchair in the low-profile configuration. FIG. 6B shows a side view of the convertible wheelchair in the low-profile configuration. Typically, in a low profile configuration, footrest 98 and caster wheels 94 are rotated forward around forward front bar 90.

Figure 7A:
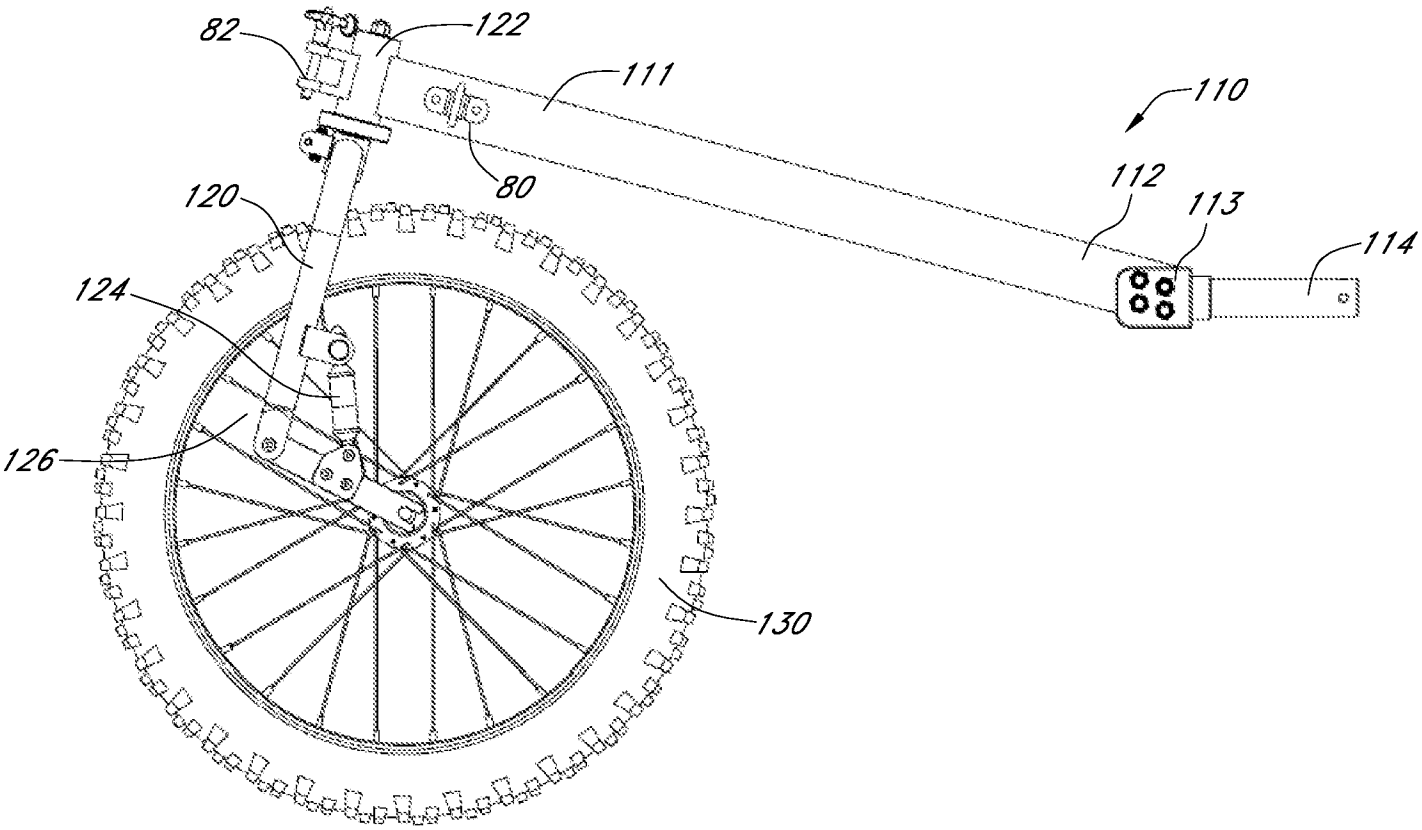
FIG. 7A shows a side view of an embodiment of a forward beam and forward wheel for attachment to a convertible wheelchair (thereby converting the wheelchair to an all-terrain configuration), with a focus on the trailing arm suspension and shock absorber arrangement.
Figure 7B:
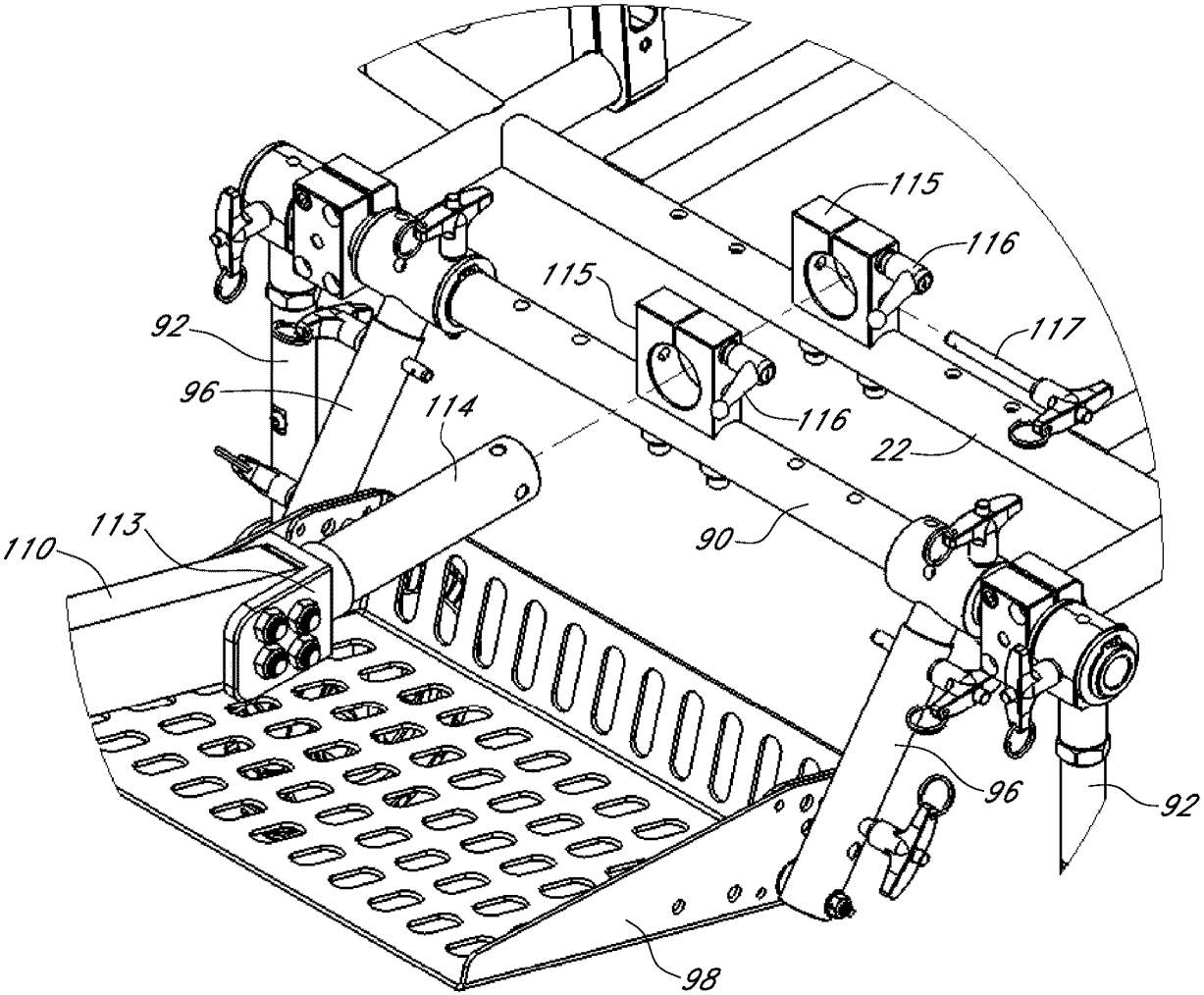
FIG. 7B shows a detailed view of how the forward beam and the central frame connect together.
Figure 7C:
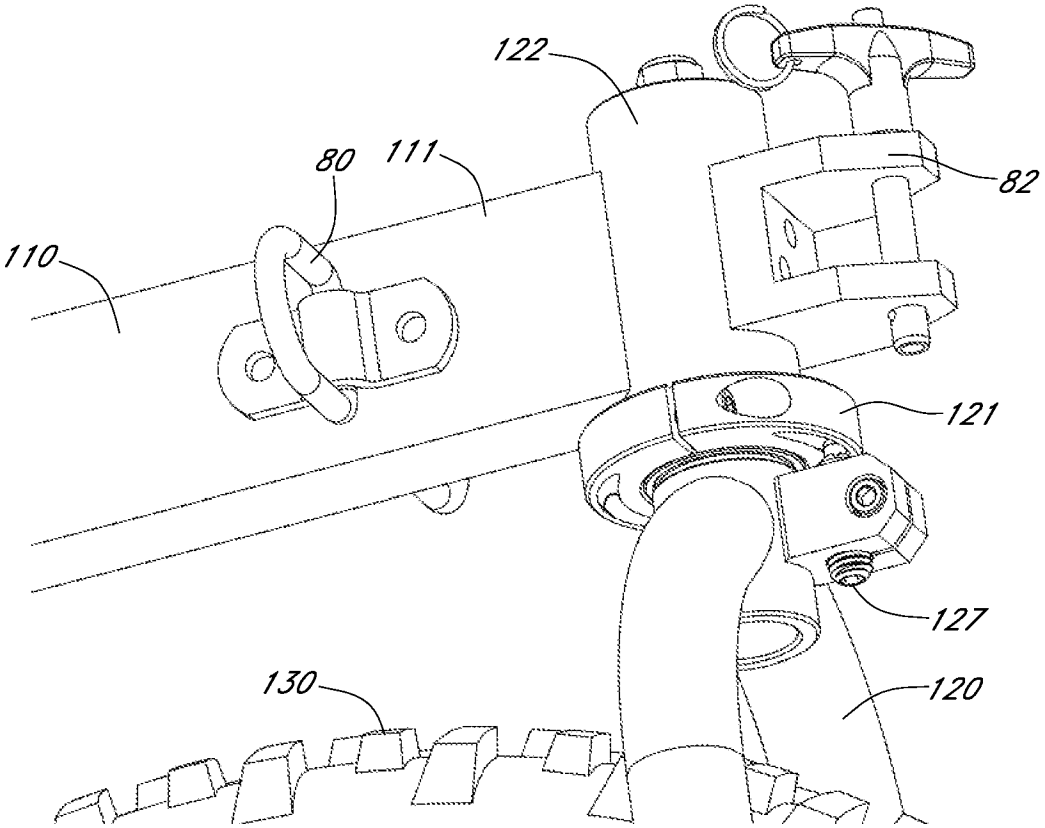
FIG. 7C shows a view of the rotatable wheel head stock and split fork as attached to the forward beam.

FIGS. 7A-7C are illustrative of an embodiment of forward beam 110 and associated features. FIG. 7A shows a side view of an embodiment of a forward beam 110 and forward wheel 130. Forward beam 110 has a front end 111 and a back end 112. When forward beam 110 is connected to a free standing convertible wheelchair 10-WC, the wheelchair assumes an all-terrain configuration 10-AT. At its front end 111, forward beam 110 supports forward wheel 130 by way of forward wheel fork 120. Forward wheel 130 features a trailing arm suspension 126 and shock absorber 124 arrangement. At least one tensioning line attachment site 80 may be disposed on one or both sides of the front end 111 of forward beam 110. Another tensioning line attachment site 82 may be disposed on or near headstock 122, facing forward, and positioned at the very forward end of forward beam 110. A more detailed view of these elements is shown in FIG. 7C showing, for example, the different structures of tensioning line attachment sites 80 and 82. FIG. 7A also shows mounting yoke 113 positioned at the back end 112 of forward beam 110; mounting yoke 113 serves as a connecting element to wheelchair connection piece 114.

FIG. 7B shows a detailed and partially-exploded view of the arrangement by which forward beam 110 attaches to the frame of the convertible wheelchair (thus becoming wheelchair embodiment 10-AT), the view showing the forward beam and the frame spaced apart, as if before connection occurs or after detachment. Coming in from the left, in this view, the back end of forward beam 110 can be seen; it is attached to wheelchair connection piece 114 by mounting yoke 113. Forward beam 110 is typically rectangular in cross section; wheelchair connection piece 114 is typically circular in cross section. Forward beam 110 may have any suitable cross sectional shape, but a rectangular shape offers high stiffness per unit mass. Connection piece 114 may have any suitable cross sectional shape, but a circular cross sectional shape pairs well with split clamp blocks 115 to form a high integrity connection of forward beam 110 to the central frame 20. There are two split clamp blocks 115, aligned with each other, one split clamp block located on forward front bar 90 and a second split clamp block on front bar 22 of the central frame.

A detent pin 117 may be installed into the cross-drilled holes of either or both split clamp blocks 115 and then the cross-drilled holes of wheelchair connection piece 114 to align forward beam 110 to the central longitudinal axis of wheelchair frame 20. Detent pin 117 also serves as a securing mechanism to anchor the tensioning forces applied to forward beam 110 in an eventuality in which the split clamp blocks 115 become loose. Ratcheting screws 116 cause split clamp blocks 115 to compress around connection piece 114; this two-point attachment arrangement creates a highly rigid connection between forward beam 110 and central frame 20.

In terms of a linear (front-to-rear) structural progression from forward beam 110 into a secure connection with central frame 20, mounting yoke 113 marks a transition from a rectangular cross sectional shape (of forward beam 110) to a round cross sectional shape (of connection piece 114). Mounting yoke 113 further accommodates an angle change from the horizontal in the rear (to align with the plane of central frame 20 and the ground surface) to an angle $\alpha$ (see FIG. 14) that determines the overall angle of forward beam with respect to the ground surface. Angle $\alpha$ may vary between about 10° to 20°, and is typically about 15°.

FIG. 7C shows a detailed view of the rotatable wheel head stock 122 and split collar 121 as attached to forward beam 110. Split collar 121 serves to secure the connection of forward wheel fork 120 to forward beam 110, by way of headstock 122.

A tensioning line attachment site 80 is disposed on the visible side of the front end 111 of forward beam 110 (another attachment site 80 is positioned on the far side of forward beam 110). A tensioning line attachment site 82 (having a different configuration of tensioning line attachment site 80, but serving the same general purpose) is disposed centrally at the very front of forward beam 110, on top of headstock 122.

Split collar 121 has two radial wedge ramps machined into its lower face, 180° apart, (these ramps are not shown) which serve to bias the rotatable forward wheel 130 to maintain a directly forward orientation, and to return to the forward orientation when it becomes directed otherwise. In greater detail, this arrangement serves two functions when engaged to the spring loaded nose of a spring plunger 127: (a) it serves as a detent to hold the forward wheel within the load/unload position of the forward beam assembly, and (b) it serves as a steering damper to slow the action of the front wheel when the wheel is pivoting left-to-right along uneven terrain. Spring plunger 127 has a male threaded body, a nose, an internal spring, and a set screw to adjust the spring preload. The nose of spring plunger 127 is compressed gradually via the action of the radial wedge ramp. The spring plunger is compressed minimally when the front wheel is tracking straight ahead at 0° pivot. Spring plunger 127 compresses gradually as the front wheel pivots from 0° to 30° as the nose of the spring plunger climbs the radial wedge ramp, thus causing more pressure to be exerted to pivot the front wheel. Split collar 121 can be adjusted into a radial position around the axis of headstock 122 to adjust front wheel 130 to track straight. Spring plunger 127 is mounted into a female-threaded split clamp block on the front fork weldment and can be adjusted up or down to increase or decrease the steering dampening effect. Screws are used at the split elements in both the split collar 121, and spring plunger's split clamp block to lock the desired setting into position.

Figure 7D:
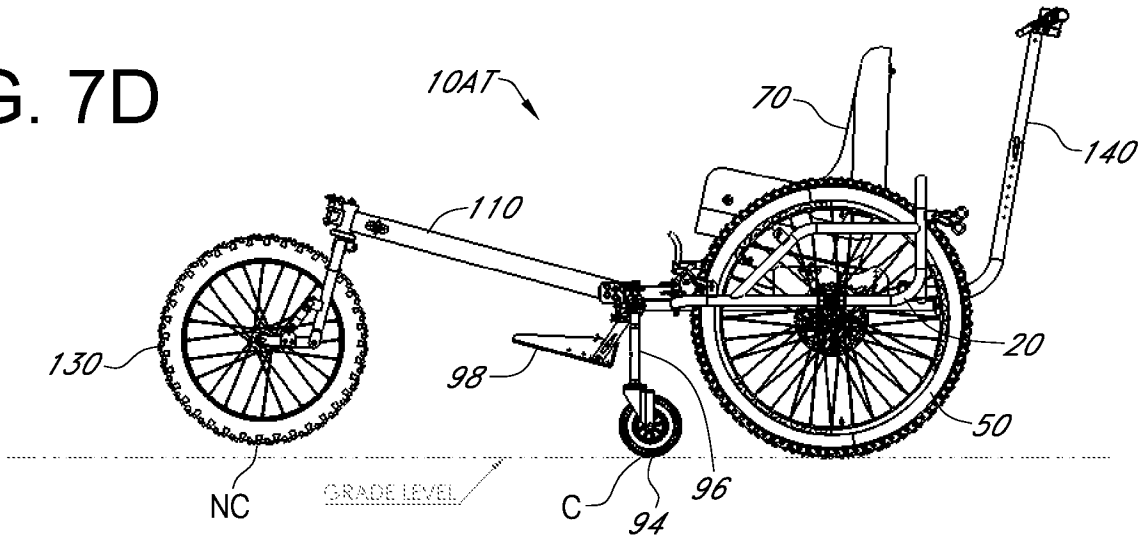
FIGS. 7D and 7E show two side views, respectively, of an embodiment of a convertible wheelchair in an all-terrain configuration, showing, in particular, the complete rotatability of the forward wheel.
Figure 7E:
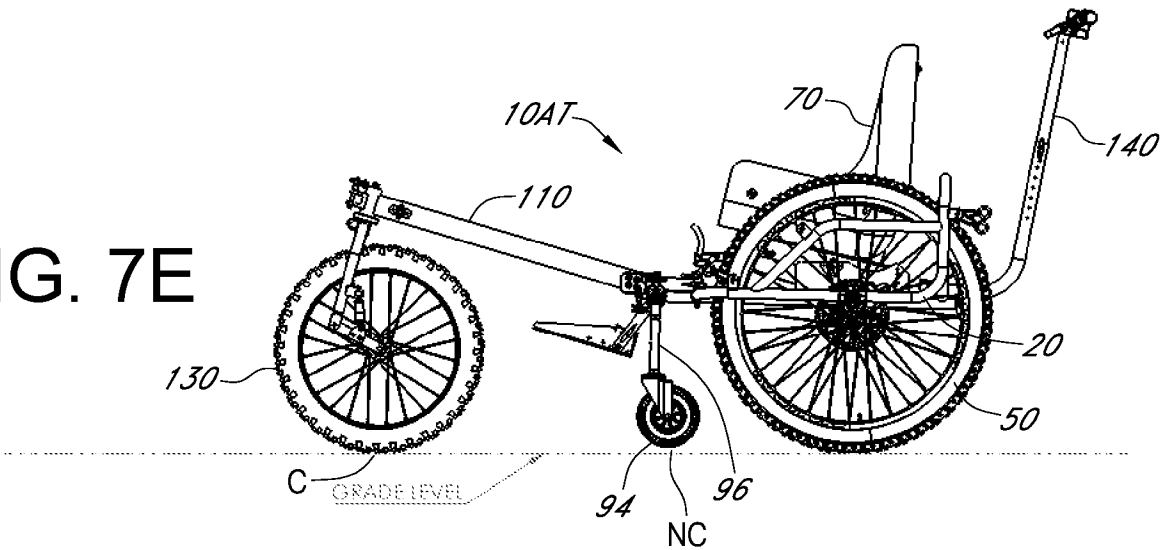

FIGS. 7D and 7E show two side views of an embodiment of a convertible wheelchair in an all-terrain configuration 10-AT, showing, in particular, the complete rotatability of the forward wheel. This configuration allows forward wheel 130 to assume two opposite positions, each one useful. In FIG. 7D, forward wheel 130 is rotated so that it is substantially forward of forward wheel fork 120; this can be considered an "install" position. FIG. 7E shows forward wheel 130 rotated so that it is substantially behind forward wheel fork 120 (thus a "trailing arm suspension" arrangement, as seen in detail in FIG. 7A); this can be considered an "operating" or ready-to-roll position.

The install position shown in FIG. 7D is useful for connecting forward beam 110 to the central frame of the wheelchair (detailed in FIG. 7B) because forward wheel 130 is positioned such that it does not contact the ground (while caster wheels 94 contact the ground), thus allowing an easy "install" by a crew member. Rotating the wheel to assume the operating configuration, as shown in FIG. 7E, lifts caster wheels 94 off the ground surface, allowing them to be freely rotated into various positions, as shown in FIGS. 10A-10F. Sites of wheel contact with the ground surface are labeled C; sites of no contact between a wheel and the ground surface are labeled NC.

Figure 8B:
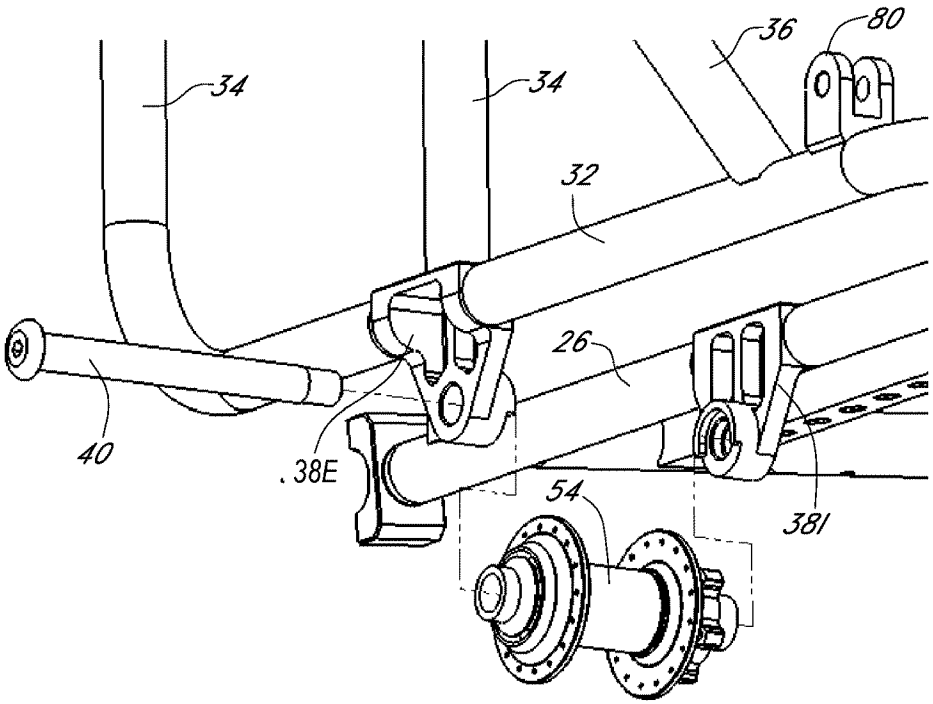
FIG. 8B shows a detailed bottom perspective exploded view of an axle dropout site (FIG. 8A) having half-moon shaped nesting sites that provide a quick alignability of the rear wheel hub with respect to the through-axle center line.
Figure 8A:
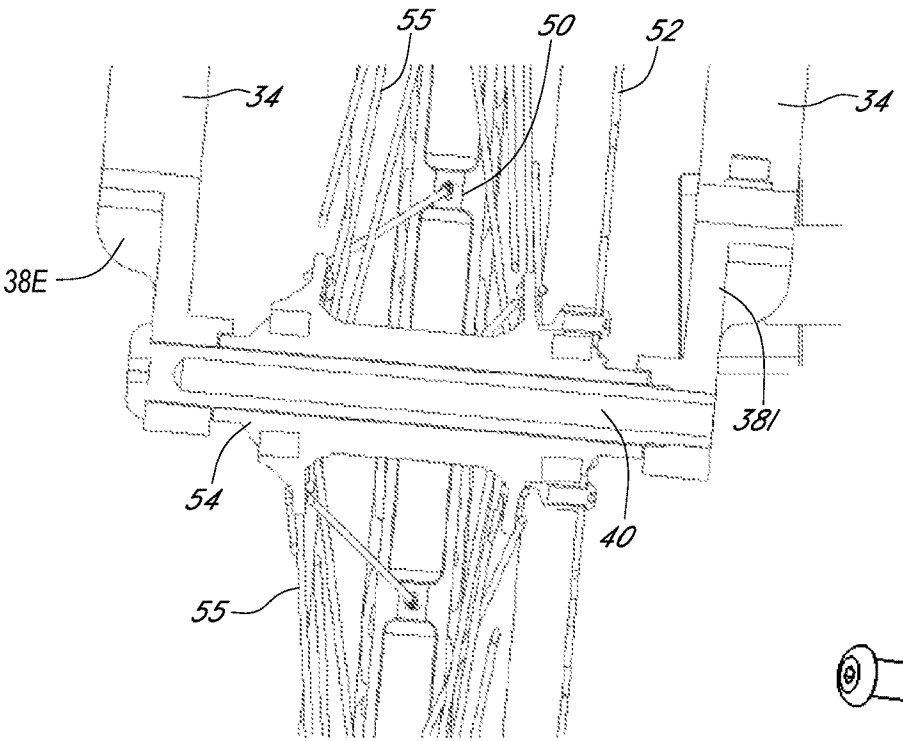
FIG. 8A shows a detail front view of one of the two rear axles, with a particular focus on a through-axle configuration, a cambered angle of the axle, and an axle dropout site configured to support the through-axle.

FIGS. 8A-8B provide detailed views of one of the rear axles 40, which support rear wheels 50 of a convertible wheelchair. FIG. 8A shows a front cross-sectional cutaway view of an axle, with a particular focus on an axle 40 having a through-axle configuration, a cambered angle of the axle (tilting downward toward the center of the wheelchair), and bilateral axle dropout sites (38E and 38I) configured to support the through-axle 40, which supports rear wheel 50.

FIG. 8B shows a detailed bottom perspective exploded view of an axle dropout site having half-moon shaped nesting sites in both inner axle dropout component 38I and outer axle dropout component 38E which, together, provide a quick alignability of the rear wheel hub 54 with respect to the through-axle center line. Wheel hub 54 is seen clearly in FIG. 8B; disc brake ring 52 is seen in FIG. 8A. Wheel spokes 55 extend outward from wheel hub 54, connecting with the rim of wheel 50.

Rear axles 40 are supported from above by the two descending arms of the clevis arch 34 and side bar 26, which is a portion of a wheel cage 30 (as seen in FIGS. 2A-2C). Rear axles 40 are more directly supported by an axle dropout arrangement having a female-threaded inner axle dropout component 38I and an outer unthreaded axle dropout component 38E. These structural aspects of the dropout sites ease the installation of the male-threaded through-axle 40 through the axle dropout sites and rear wheel hubs 54.

Figure 9A:
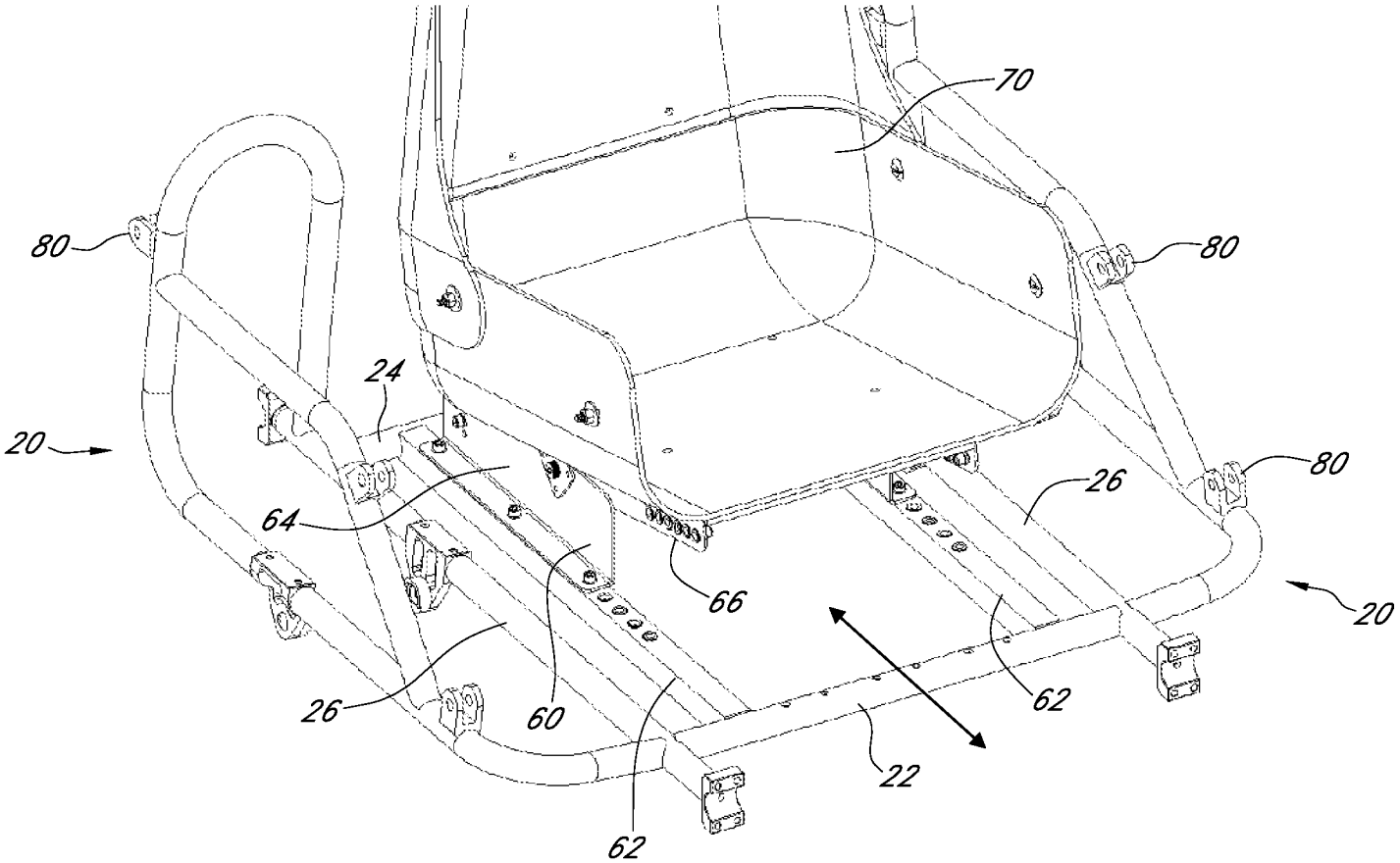
FIGS. 9A-9D show views of an embodiment of a seat for the convertible wheelchair, with a focus on seat adjustment features.

FIGS. 9A-9D show various views of an embodiment of a seat 70 for convertible wheelchair 10, with a focus on seat adjustment features, including a forward-aft adjustment (see arrow) and an angular seat incline adjustment. FIG. 9A shows a view of seat 70 disposed in an aft position on seat mount assembly 60, which includes support rails 62 (the rails defining bolt holes arranged from varying fore-aft positioning of the chair), sides 64, and angled seat platform 66. Seat mount assembly 60 is supported by central frame 20, more particularly, seat mount support rails 62 are supported by front bar 22 and back bar 24 of the central frame.

Seat 70 may have multiple optional sizes, each one configured to be supported by seat mount assembly 60. In one example, three sizes (small, medium, and large) are available for riders of varying size, although any size is envisaged. FIG. 9A also shows the forward-aft positional adjustability of seat 70. Seat mount support rails 62 may define multiple mounting bolt holes on the upper surface of the rails; seat 70 can be bolted in at a range of positions along the rails (see arrow) to place the seat at a position appropriate for wheelchair riders of different sizes.

Figure 9D:
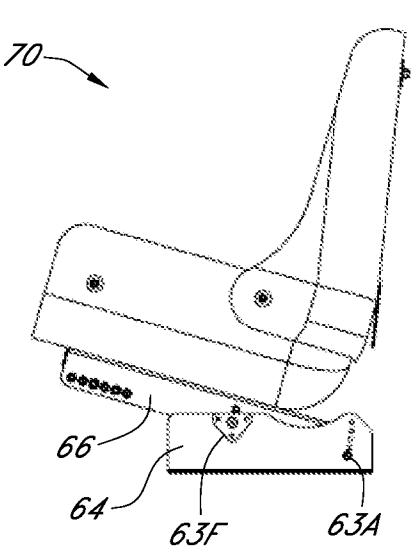
Figure 9C:
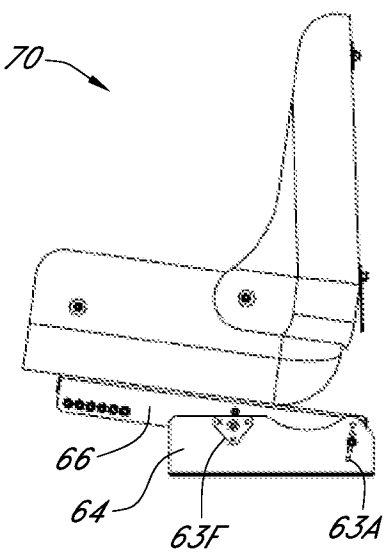
Figure 9B:
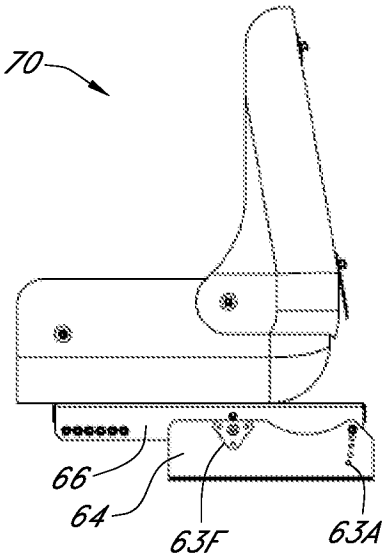

FIGS. 9B-9D show seat 70 at various angled positions on angled platform 66, which is supported by seat mount sides 64. FIG. 9B shows the seat positioned at horizontal angle; FIG. 9C shows the seat at a moderately tilted angle; and FIG. 9D shows the seat at a fully tilted angle. Seat angled platform 66 is supported within seat mount sides 64 by bolts within bolt holes at a forward position 63F and at an aft position 63A. Forward bolt hole 63F has a single fixed position and provides an axis upon which angled platform 66 can tilt. Aft bolt hole 63A has a curved configuration that allows for the rear of the seat to be positioned at various elevations within the curve, allowing the seat to be fixed at various angles.

In one example, seat incline adjustments are positioned in 4° increments. Seat incline is typically set prior to loading the rider onboard. Seat incline positions are achieved via bolting in to a selected position. As depicted, the incline from horizontal in FIG. 9B is at a 0° incline, FIG. 9C is at an 8° incline, FIG. 9D is at a 16° incline. These are merely examples of incline degree increments.

Altogether, seat 70 and aspects of footrest 98 and their respective support elements, provide a high degree of customizability, adjustability, and overall fit for riders. To recount, seat 70 can vary in size, its fore-aft position is adjustable, and the seat incline angle is adjustable. Footrest 98 is also highly adjustable, as for example the length of its support arms, and its rotational positioning. These various features of footrest 98 are shown variously in FIGS. 7B, 7D, 7E, 10A-10F.

Figure 10A:
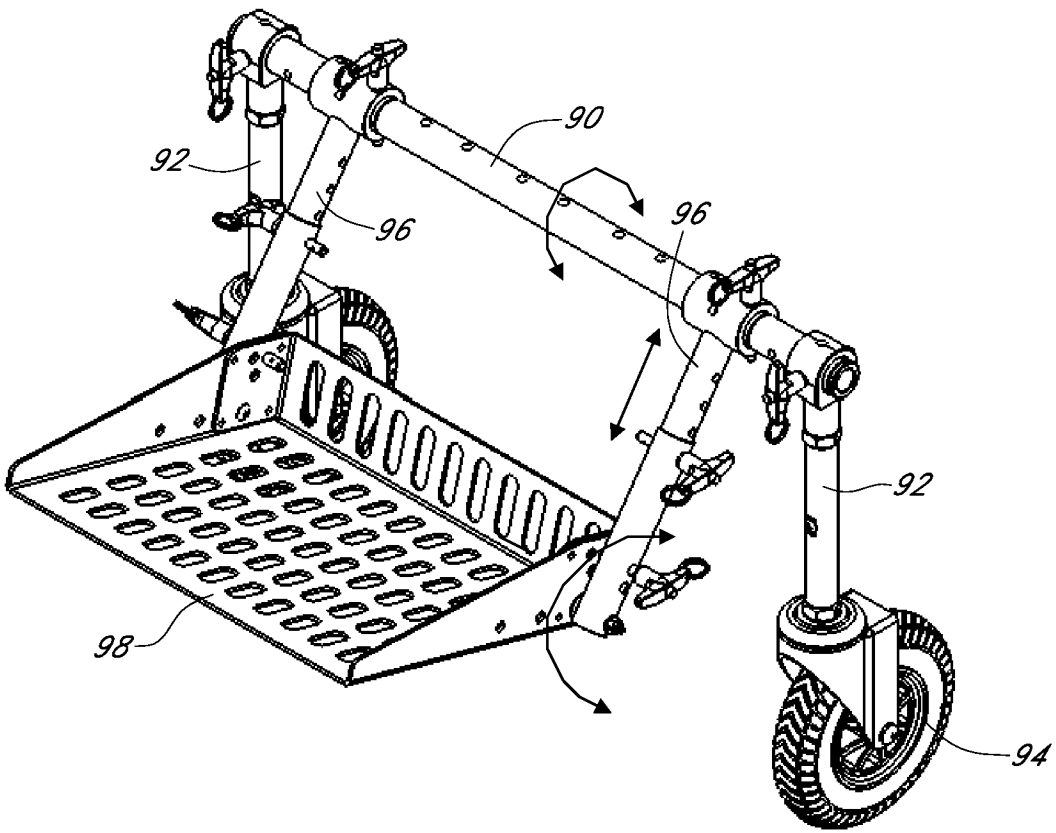
FIGS. 10A-10F show various detailed views of embodiments of a footrest and caster wheels, with a focus on their adjustability.

FIGS. 10A-10F show various detailed views of embodiments of a footrest 98 and caster wheels 94, with a focus on their adjustability. FIG. 10A is a front perspective view of a wheelchair footrest and caster wheels; the larger context into which the footrest is disposed may be seen in any of FIG. 1A, 1B, or 2B. FIGS. 10A-10F, collectively show the independent rotatability of caster wheel legs 92 (supporting caster wheels 94) and footrest support arms 96 around forward front bar 90. In greater detail, footrest support arms 96 each are suspended from the forward front bar 90 by sleeves that allow rotation around the bar, but which can be locked at a desired angle. This sleeved arrangement, with the footrest forming a link between each sleeve, keeps the support arms in rotational synchrony. Caster wheel legs 92 rotate independently of each other, are lockable at a desired angle, and they collectively rotate independently of the footrest support arms.

Footrest support arms 96 can be telescopically adjustable, one tubular section sleeved around another tubular section. This telescopic feature provides an adjustability (see arrow) to the distance between the forward bar and the footrest, this providing an adjustability to fit a wheelchair rider.

Figure 10C:
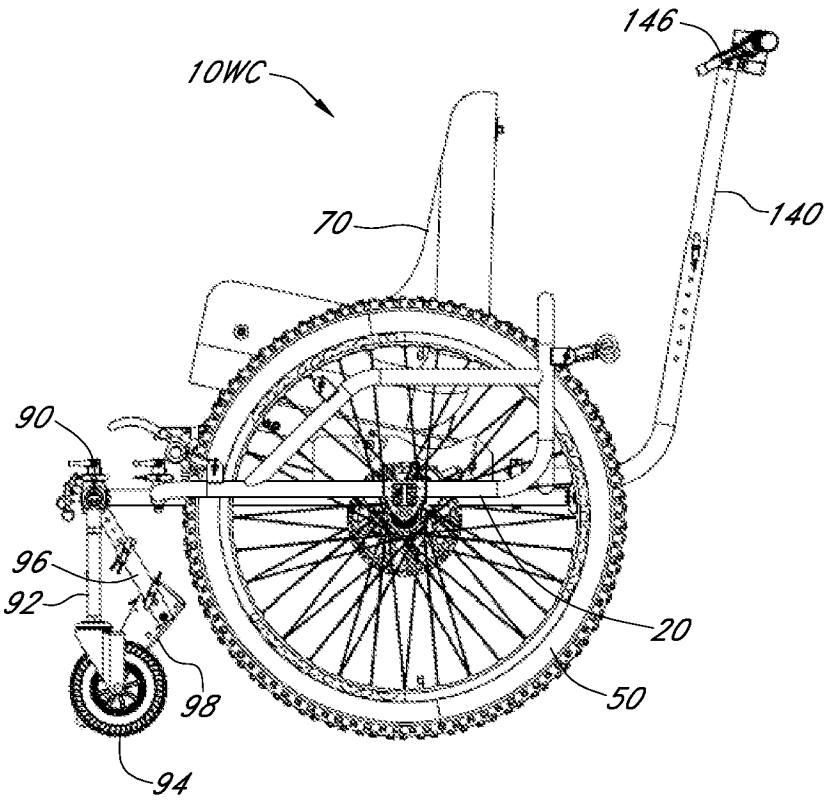
Figure 10B:
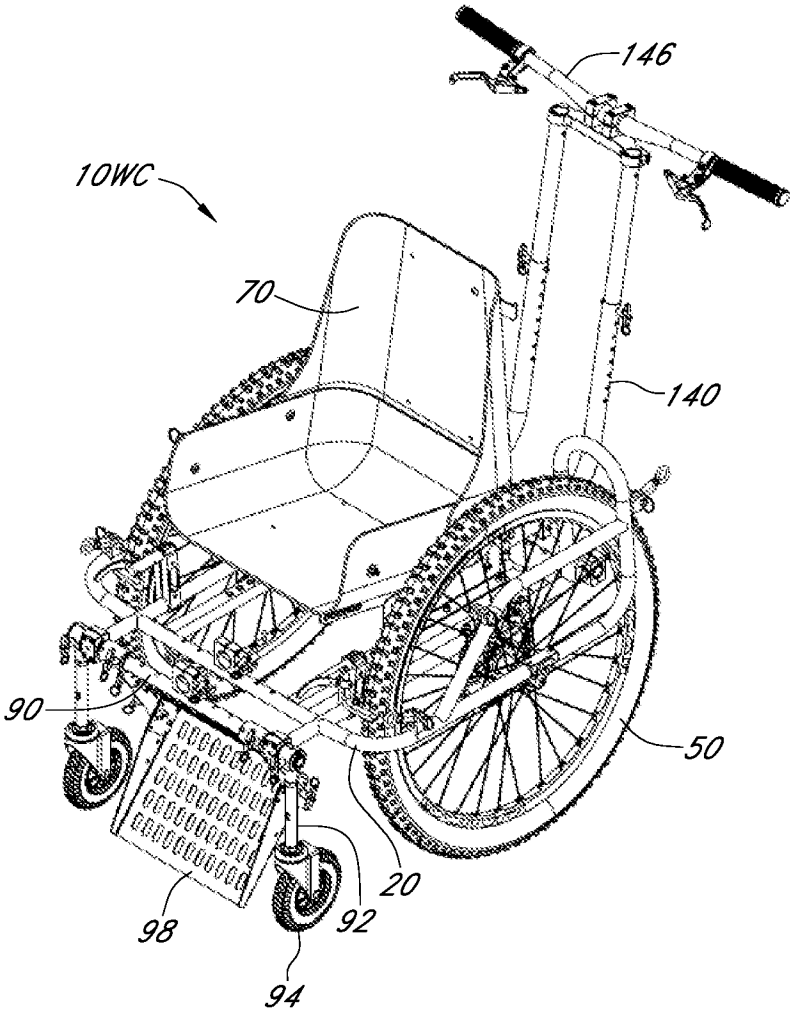

FIG. 10B shows a front perspective view of wheelchair embodiment 10-WC, with footrest 98 (as supported by support arms 96) and caster wheels 94 (as supported by caster wheel legs 92) in a fully down and rearward rotated position. This position of footrest 98, in particular, gets it of the way and allows an unimpeded entry for a rider to become situated into the wheelchair. FIG. 10C shows a side view of wheelchair embodiment, with the footrest and caster wheels in a fully down (and rearward rotated) position (as in FIG. 10B).

Figure 10D:
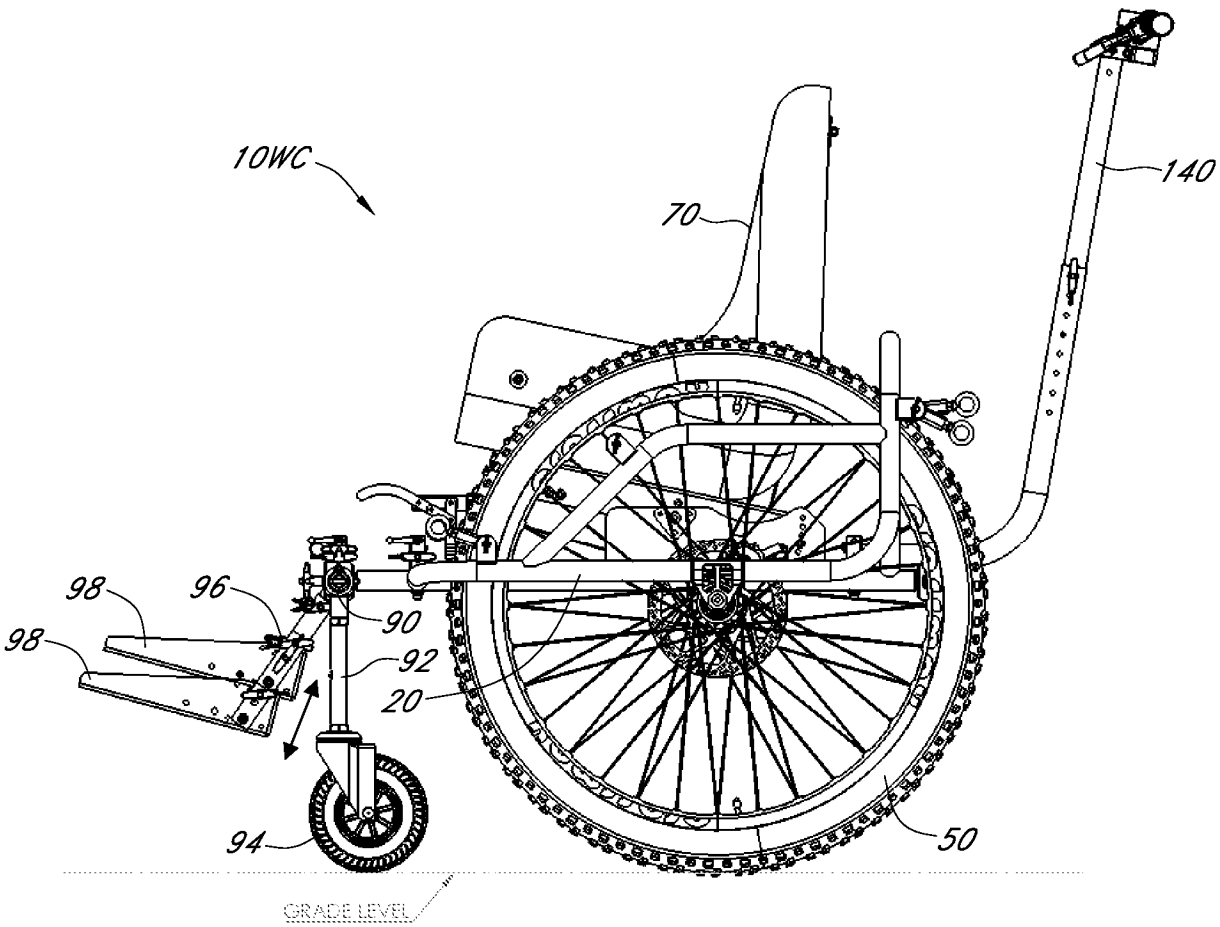

FIG. 10D shows a side view of a wheelchair embodiment with the footrest 98 in two height positions (see arrow), the rotational angle of the footrest support arms 96 around forward front bar 90 being held constant. This adjustment allows the footrest to be adjustable to fit a wheelchair rider.

Figure 10E:
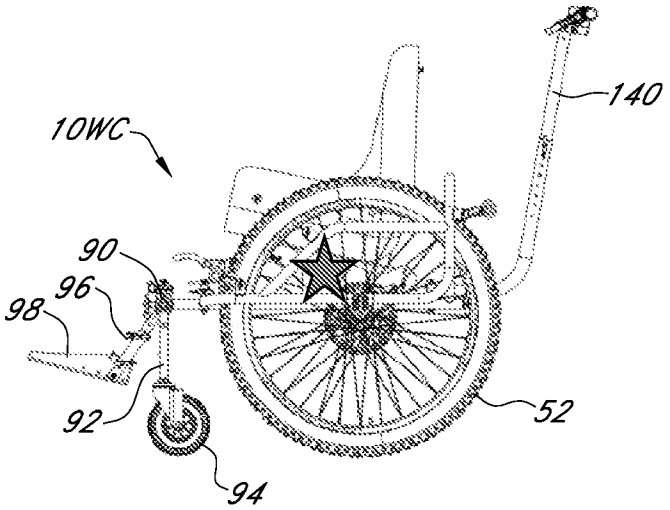
Figure 10F:
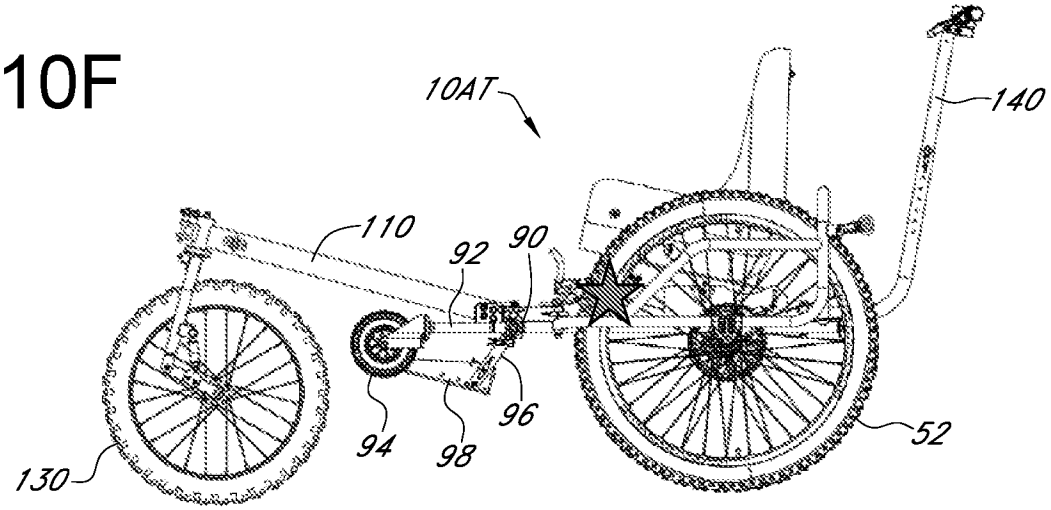

FIGS. 10E-10F show an aspect of the rotational adjustability of footrest 98 and caster wheels 94 that optimizes their positioning to suit a convertible wheelchair in wheelchair configuration 10-WC and in all-terrain configuration 10-AT, respectively. FIG. 10E shows a side view of a convertible wheelchair embodiment (in wheelchair configuration 10-WC), with the footrest rotated to about a 20° angle from the vertical position (relative to caster wheel legs 92) for supporting a rider's feet when the convertible wheelchair is in a wheelchair configuration, and further showing the caster wheels disposed in a vertical position, as appropriate in the wheelchair configuration. FIG. 10F shows a side view of a convertible wheelchair (in all-terrain configuration 10-AT), with the footrest 98 (as supported by support arms 96) rotated to about a 35° angle from the vertical and the caster wheels rotated to a horizontal position, substantially in line with the frame, these positions maximizing the ground clearing space in the central longitudinal space underneath the wheelchair.

FIGS. 10E and 10F also show the location of the longitudinal center of gravity (see the star) of each wheelchair configuration 10-WC and 10-AT, respectively. Laterally, of course, the latitudinal center of gravity is in the center (not shown) of each wheelchair configuration.

Figure 11B:
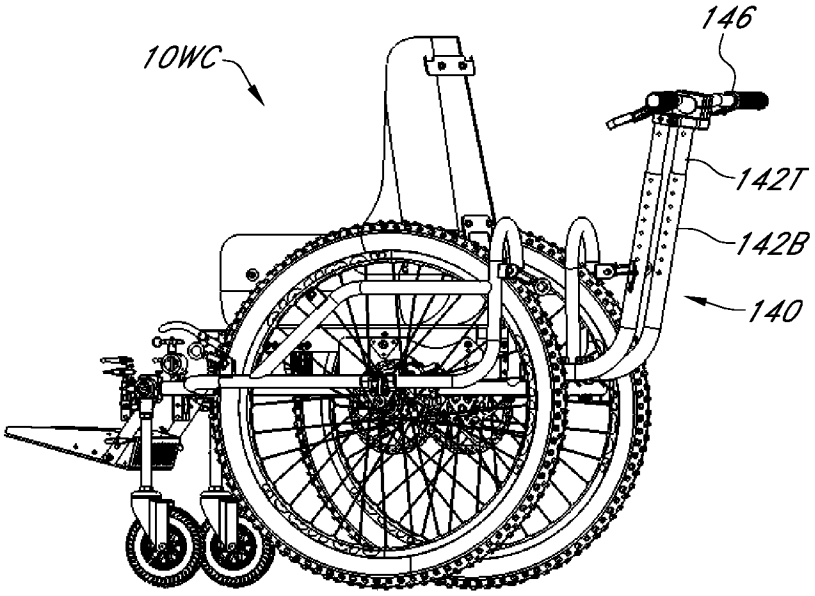
FIGS. 11A-11B show views of a steering column and its height adjustability.
Figure 11A:
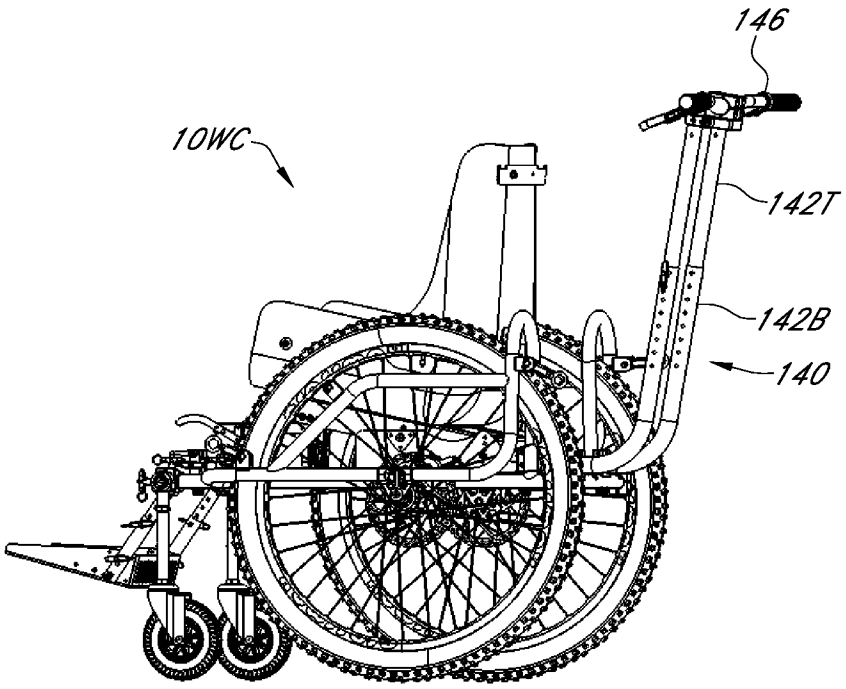

FIGS. 11A-11B show views of a steering column 140 and its height adjustability, by way of a telescopic relationship between support post top portion 142T and support post base portion 142B. FIG. 11A shows the steering column in a fully raised position. FIG. 11B shows the steering column in a fully lowered position. This level of adjustability is an ergonomic feature that allows the handlebar 146 to be positioned comfortably for a crew member working as a driver.

Figure 12B:
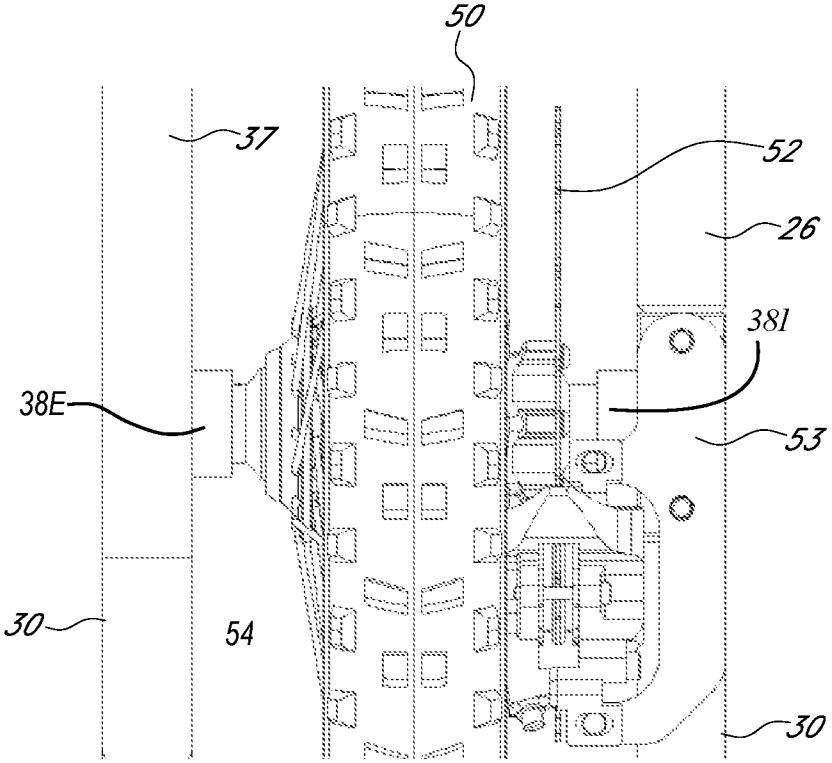
FIGS. 12A-12B show detail views of an embodiment of a disc brake mounting bracket.
Figure 12A:
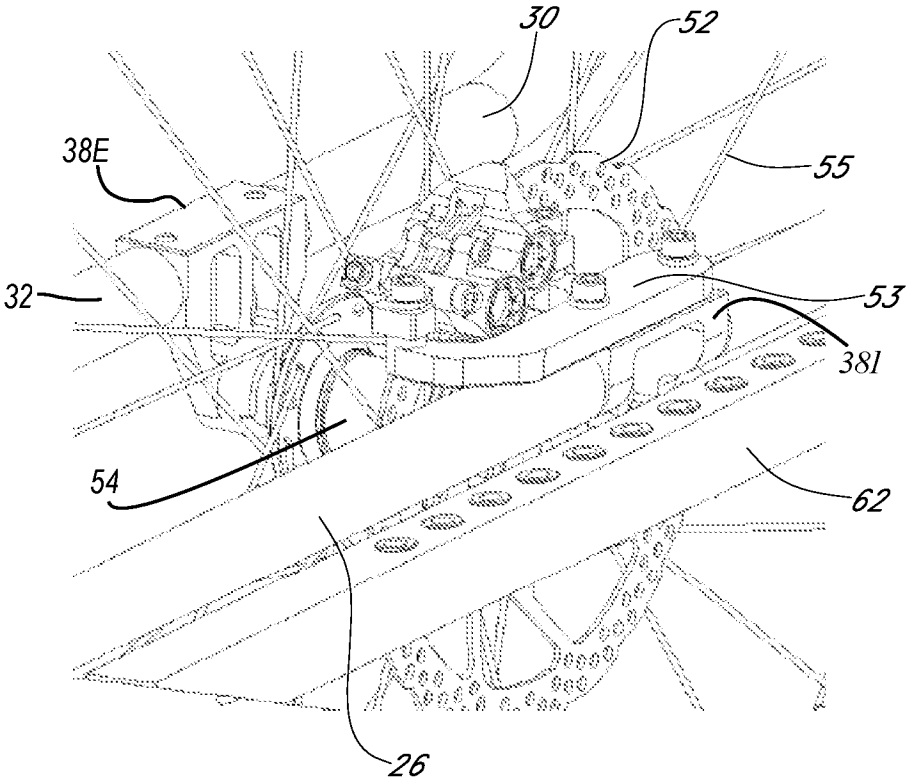

FIGS. 12A-12B show detail views of an embodiment of a disc brake mounting bracket 53. FIG. 12A is an upper perspective view of the disc brake mounting bracket 53, looking outwardly from an interior position within the wheelchair (on the right side of the figure), and toward the exterior of a wheel cage (on the left). Radiating spokes belong to a rear wheelchair wheel (not labeled). FIG. 12B is a top view, with the exterior of the wheel on the left and the interior on the right. An axle dropout site has an interior portion 38I and an exterior portion 38E. Interior portion 38I is mounted on sidebar 26 of a wheel cage, and exterior portion 38E is mounted on exterior rail 32 of a wheel cage. Disc brake mounting bracket 53 is mounted on top of axle dropout site 38I of a wheel cage 30. Handrail section 37 (of wheel cage 30, as shown in FIG. 2A) is seen opposite sidebar 26. Further features associated with FIGS. 12A-12B are described above, in context of FIGS. 8A-8B.

Figure 13A:
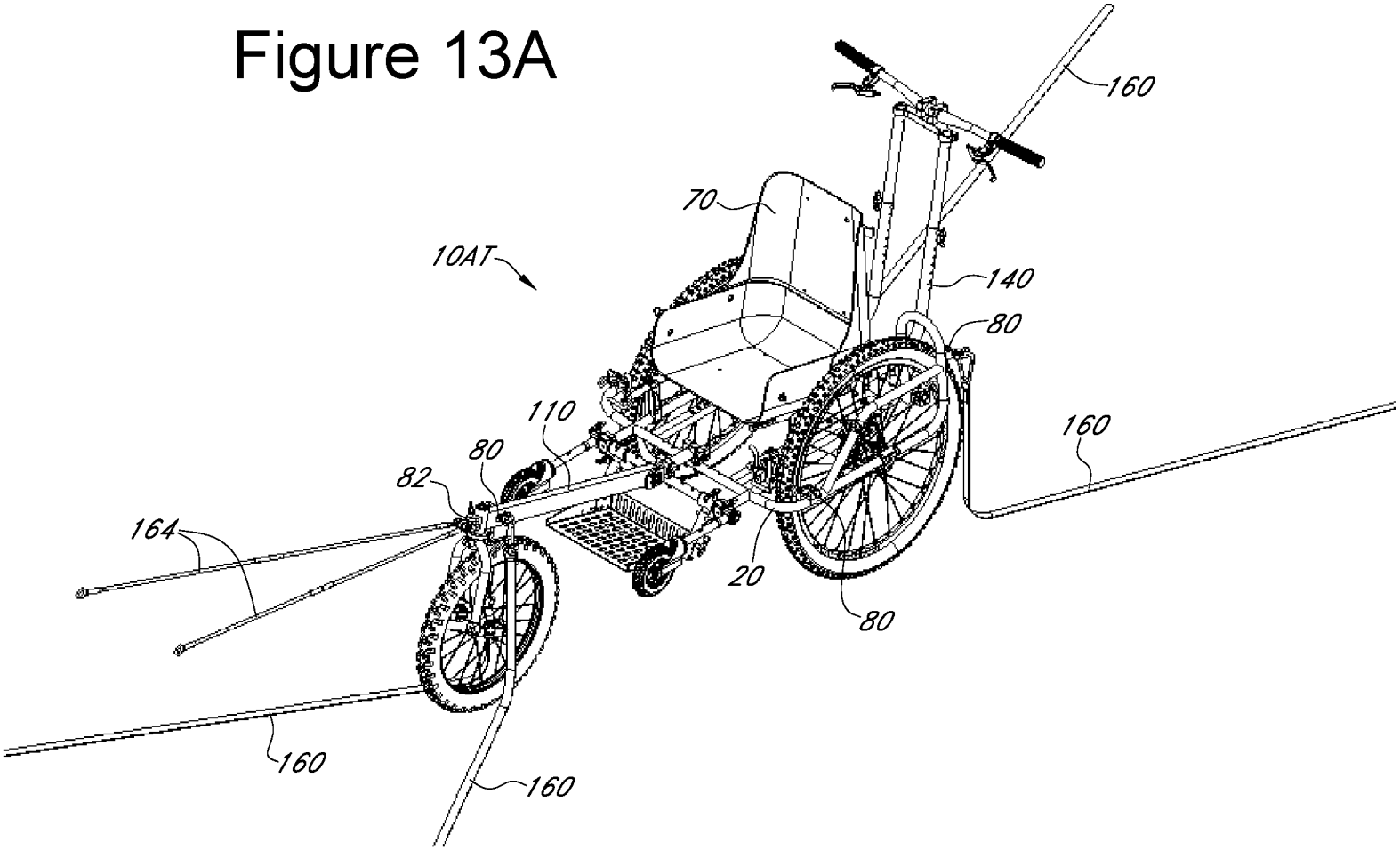
FIG. 13A shows tensioning line attachment sites on a wheelchair embodiment, as disposed on the central frame and forward beam, with tensioning lines attached, laying loose on the ground surface.

FIG. 13A shows tensioning line attachment sites on a wheelchair embodiment, as disposed on the central frame 20 and forward beam 110, with tensioning lines 164 (typically in the form of poles) and 160 attached, the latter laying loose on the ground surface.

Figure 13B:
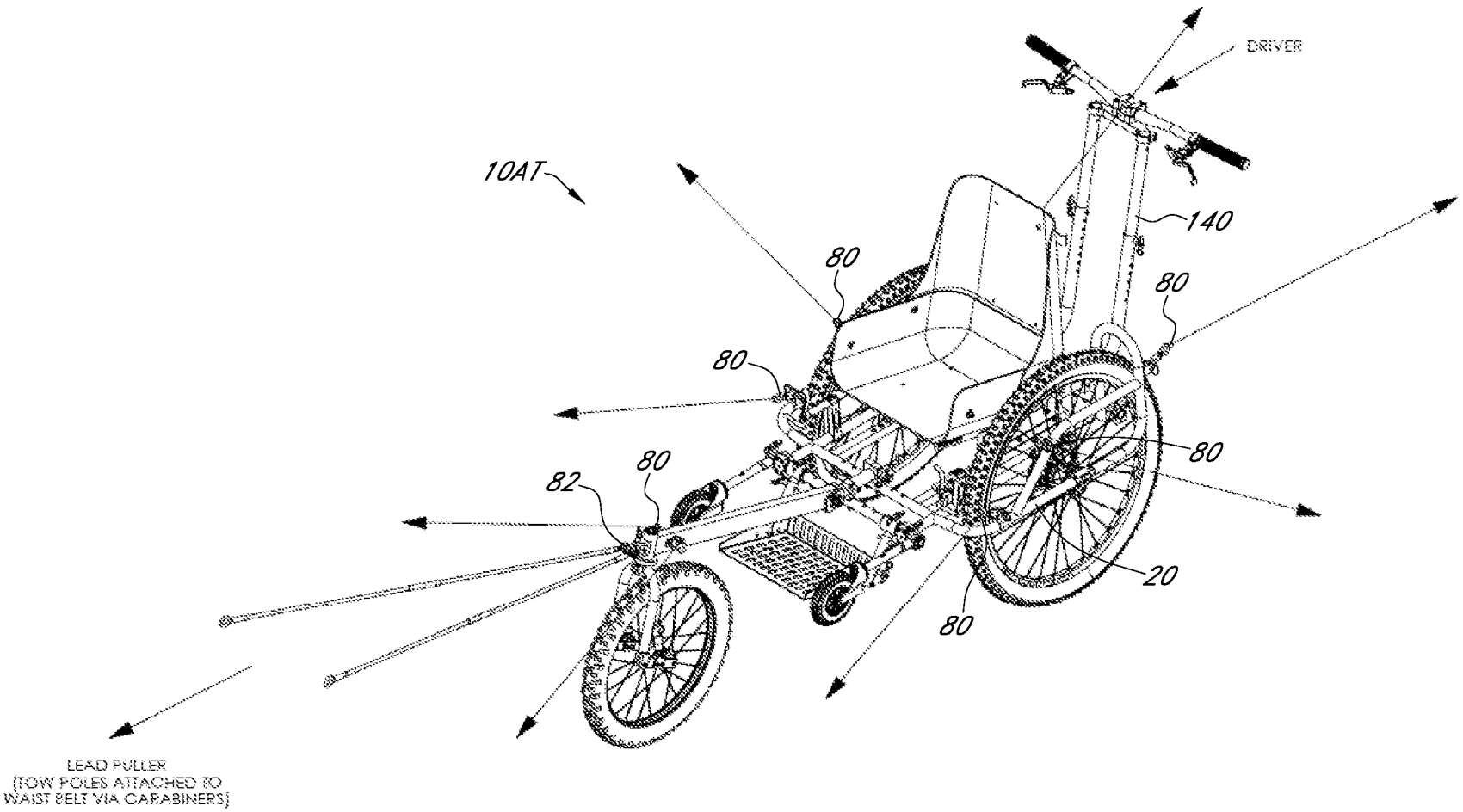
FIG. 13B shows tensioning line attachment sites on a wheelchair embodiment, as disposed on the central frame and forward beam, with tensioning lines attached and pulled taut, and represented as vectors extending outward from their attachment sites.

FIG. 13B shows tensioning line attachment sites on a wheelchair embodiment, as disposed on the central frame 20 and forward beam 110, with tensioning lines (attached and pulled taut) and represented as vectors extending outward from their attachment sites 80 and 82.

Figure 14:
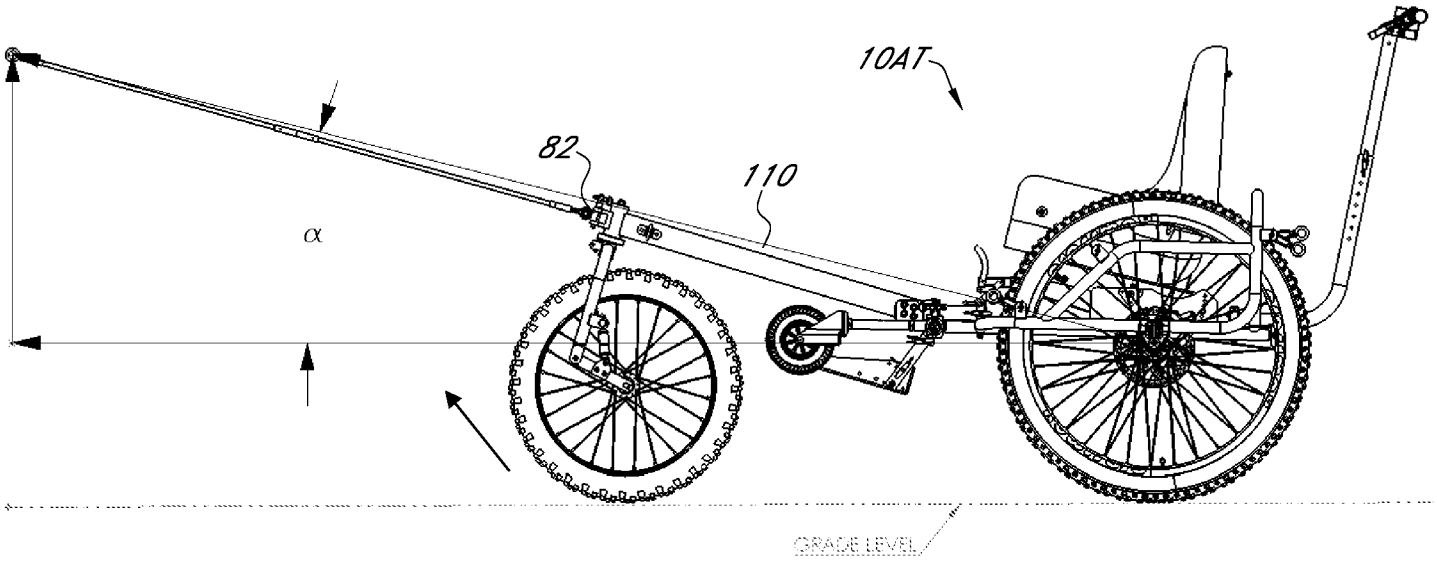
FIG. 14 shows a tensioning line (in the form of a towing pole) as attached to a forward beam of an all-terrain wheelchair.

FIG. 14 shows a tensioning line (in the form of a towing pole) as attached to a forward beam of an all-terrain wheelchair, and at a forward pull angle α with respect to a horizontal ground surface or grade level, the tensioning line being held by a crew member acting as lead puller. Angle α is typically about the same as the angle of the forward beam, itself, with respect to a horizontal ground surface, when the forward beam is attached to the wheelchair. Pull angle α can vary slightly depending on the lead puller's height. With the pull angle and the forward beam angle being substantially identical, a pull vector generally pulls directly through the main wheel axis.

In one example, by using the law of sines for a typical pull angle α (approximately 15°), for every 100 lbs. of horizontal force applied by the crew member as lead puller, a vertical force of approximately 27 lbs. is applied to help lift front wheel 130 up, over, or around encountered obstacles. This degree of lift, as provided by a line of force through the axles, and at pull angle α, provides an advantageous ability of all-terrain wheelchair 10-AT to roll over obstacles (which otherwise would be an impediment) with ease.

FIGS. 15A-15B show lateral-pulling tensioning lines (attached to tensioning line attachment sites 80) and how they are used to constrain lateral movement or prevent lateral tipping of wheelchair 10-AT. FIG. 15A shows a rear view of a wheelchair in an all-terrain configuration 10-AT on a surface sloping down to the right as it is being secured by tensioning lines on the left side of the chair. FIG. 15B shows a rear view of a wheelchair in an all-terrain configuration 10-AT on a surface sloping to down to the left as it is being secured by tensioning lines on the right side of the chair. The role of crew members in stabilizing a wheelchair on a lateral slope is shown in FIG. 18D.

Figure 16C:
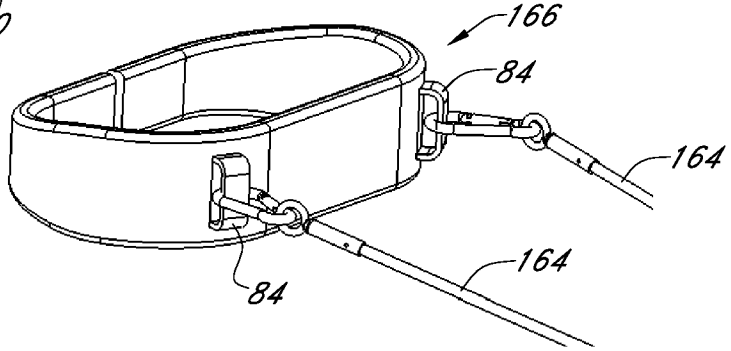
Figure 16A:
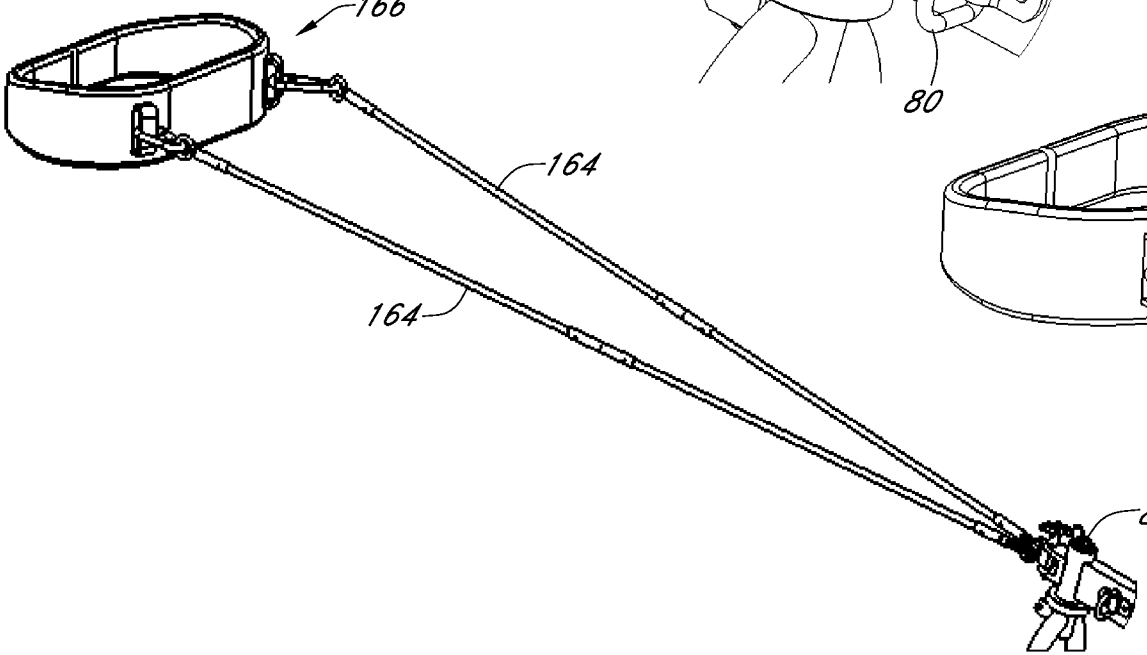

FIGS. 16A-16C show aspects of a tensioning line embodiment and its attachment to an attachment site on the forward beam 110. FIG. 16A shows the full length of the tensioning line 164, from its proximal end (attached to a tensioning line attachment site 82) to its distal end 84, which may be attached to a waist belt 166 to be worn by a crew member. FIG. 16B shows a detail view of the proximal end of the tensioning line 164 and its attachment to an attachment site 82 on the forward beam 110. FIG. 16C shows a detail view of the distal end 84 of the tensioning line 164 and its attachment to a waist belt 166.

FIG. 16A shows an example of a tensioning line (a stiff line, in the form of a towing poles 164) as attached to the forward beam 110 and a crew member's waist belt 166. Towing poles 164 typically are formed of a solid material (fiberglass) with aluminum threaded connectors on each end. In one embodiment, towing pole 164 is separated into connectible sections about 3' long. The aluminum connectors have two ends, one end features a bore and a cross drilled hole. One end of the fiberglass rod is inserted into this bore then pinned via a spring pin. The opposite end of the aluminum connector features a female threaded bore. The towing poles sections are connected to one another via a male threaded stud that is of sufficient length to engage the female threaded bores of butted aluminum connectors. The towing poles are segmented so that they can be broken down into shorter lengths and can be stowed in a bag along with the waist belt for easy transport between uses of the wheelchair.

FIG. 16B shows some further details of a tensioning line embodiment and its attachment to an attachment site 82 (on forward beam 110) and a tensioning line in the form of a pole 164. Male threaded spherical bearing rod ends are threaded in to the female threaded bore of an aluminum connector 165. The spherical bearing end of the male threaded rod ends are bolted to a steering block via a standard bolt and nut. The steering block is connected to the steering clevis on the headstock 122 of the forward beam 110 with a detent pin 166. The detent pin allows for fast installation and removal of the towing poles 164 to the steering clevis, and also creates an axis for the steering block to turn left or right. The ability of towing poles 164 to turn left or right at the front of the forward beam is essential for navigating sharp turns that are encountered along the trail, such as switchback type turns.

FIG. 16C shows how the tensioning lines (in this embodiment, towing poles 164) are connected to a waist belt 166 via male threaded eye bolts that are threaded into the female threaded bore of the aluminum connectors, and carabiners that attach to the waist belt loops. The waist belt can be used with or without suspenders, at a crew member's preference.

Figure 17A:
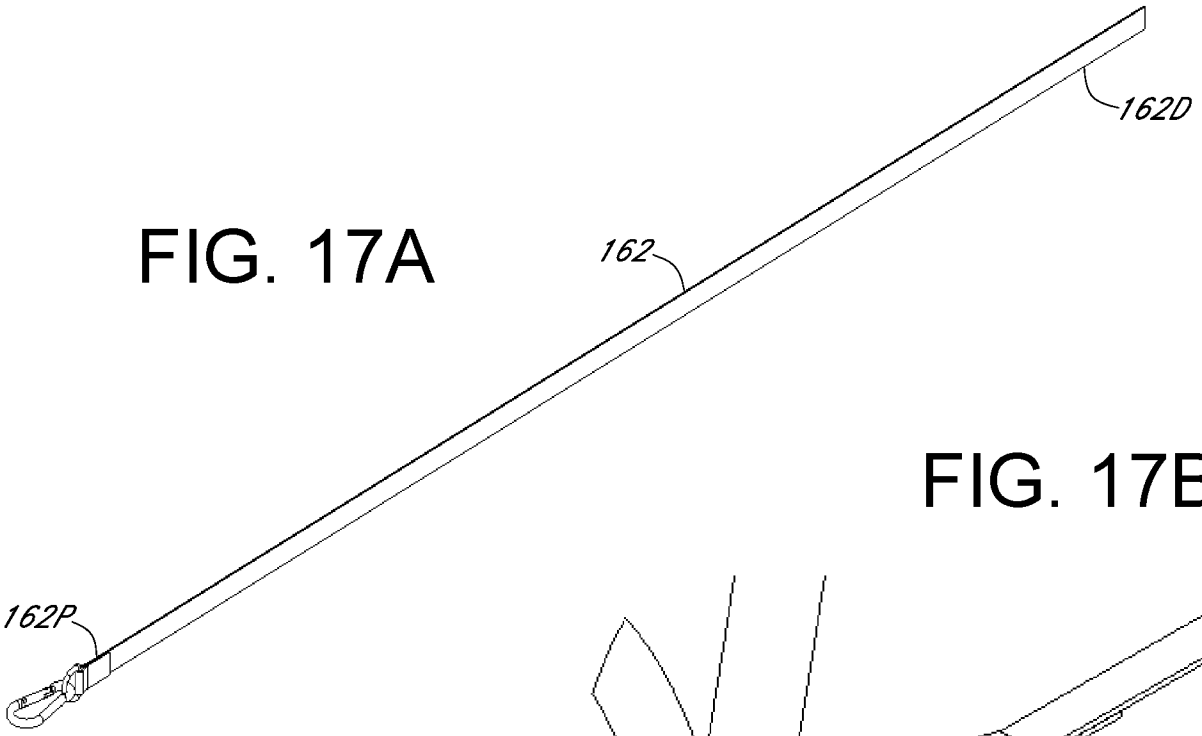
FIGS. 17A-17B show views of a loose or flexible tensioning line and its attachment site on the central frame.
Figure 17B:
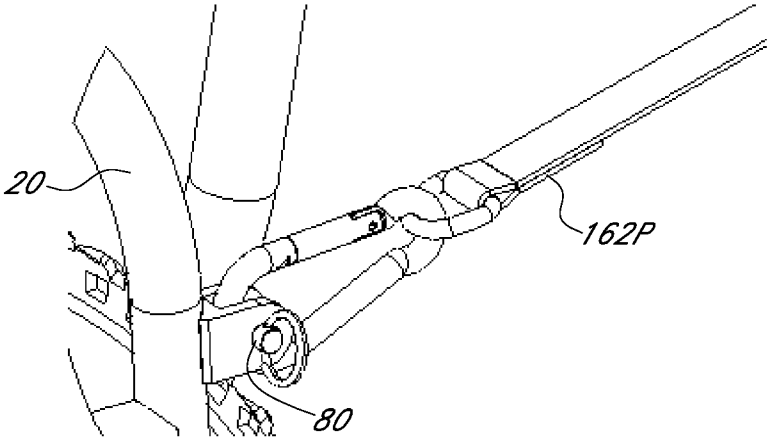

FIGS. 17A-17B show views of a loose or flexible tensioning line 162, as may be attached to central frame 20 and by way of an attachment site thereon. FIG. 17A shows the tensioning line, in full, from its proximal end 162P to its distal end 162D, to be held by a crew member when controlling the wheelchair. FIG. 17B shows a detail view of the proximal end of the tensioning line 162P to a tensioning line attachment site 80 on the frame 20 of the wheelchair.

In some further detail, FIG. 17A shows a typical tensioning line 162 with a carabiner attached to a D-ring end. In one example, a typical tensioning line is a 1 inch wide nylon strap with a D-ring attached at one end and is approximately 15 feet in length. FIG. 17B shows the tensioning line 162 attached to a frame 20 mounted tensioning line attachment site 80 (in the form of clevis) via a carabiner and a clevis detent pin.

In an alternative embodiment provided herein is a 3-wheeled all-terrain wheelchair. This all-terrain wheelchair embodiment is one that appears very similar to all-terrain wheelchair 10-AT, as shown and described herein, but is one in which the forward beam and the central frame are fixedly connected together, or fully integrated into a single structure (rather than being separate pieces that are connectable and detachable). All-terrain wheelchair 10-AT is shown in numerous figures (including FIGS. 1B, 4A-4C, 7D-7E, 10F, 13A-13B, 14, and 18A-18D), all of which are similarly illustrative of this alternative embodiment in the form of a 3-wheeled all-terrain wheelchair.

The site at which the 3-wheeled all-terrain wheelchair embodiment varies from all-terrain wheelchair 10-AT can be localized to the region shown in FIG. 7B. In that figure, the connection piece 114 is shown, in an exploded manner, as disconnected from the central frame, but fully connectable by way of the split clamp blocks 115. In the present 3-wheeled all-terrain wheelchair, that connection would be secured or fixed, and not amenable to a quick disconnect. The overall structure of that connection region could be simplified, with fewer connecting components, and accordingly be less expensive to manufacture.

A 3-wheeled all-terrain embodiment may, in some instances, be preferred in some niches in the market. For example, a wheelchair rider might already be fully satisfied by their conventional wheelchair, for navigating indoors, or on smooth and level terrain, and want an all-terrain wheelchair strictly for trail use. In another example, an organization with a focus on all-terrain wheelchair navigation may be located at a trailhead, and have a fleet of all-terrain wheelchairs to rent. In that circumstance, a (non-convertible) 3-wheeled all-terrain wheelchair may best suit their needs.

Accordingly, embodiments of the invention include a three-wheeled all-terrain wheelchair having a full wheelchair frame aligned along a central longitudinal axis, the full frame including a central frame and a forward beam fixedly connected together. The central frame includes a front bar and a back bar parallel to each other and orthogonal to the central axis, a forward front bar (in front of- and parallel to the front bar), paired side bars (each aligned with the central axis), and paired wheel cages, each wheel cage aligned in parallel with the central longitudinal axis and attached to the front and back bars of the frame, and each configured to support a rear wheel. The forward beam is aligned with the central longitudinal axis, and includes a front end and a back end, wherein the front end of the forward beam is configured to support a forward wheel, and wherein the back end of the forward beam is connected to the central frame. In some embodiments, the connection of the forward beam and the central frame includes an arrangement whereby the forward beam is connected to both the front bar and the forward front bar of the wheelchair frame.

In addition to the structural aspects of convertible wheelchair embodiments (particularly in all-terrain configuration 10-AT) of the invention include methods for controlling (or contributing to the control) of movement of the wheelchair, as shown in FIGS. 18A-18D. All-terrain wheelchair 10-AT is designed and configured particularly for wheelchair crew members to engage in controlling movement of the wheelchair in various ways, as described below.

These illustrated methods of controlling movement of wheelchair 10-AT are typically implemented by one or more wheelchair crew members 170, who engage the wheelchair by way of tensioning lines that attach to specific tensioning line attachment sites on central frame 20 of the wheelchair, or on forward beam 110. In a related method of controlling movement of a wheelchair, a crew member 170 is positioned behind the wheelchair, and controls the chair by way of a steering column 140.

Wheelchair 10-AT, as described in detail above, typically includes a central frame, a pair of back wheels, a forward wheel mounted on a forward beam connected to the frame, a plurality of tensioning line attachment sites attached to the frame, and one or more tensioning lines attached to one of the tensioning line attachment sites.

The various methods of controlling movement of the convertible wheelchair, as provided herein, all include providing a wheelchair movement crew of one or more members; attaching a distal end of a tensioning line to a tensioning line attachment site on the central frame of the convertible wheelchair or on the forward beam; and applying tension to the distal end of the tensioning line. The one or more crew members are the ones exerting the tension. Accordingly, the one (or more) crew member thereby controls (or contributes to controlling) movement of the convertible wheelchair.

"Crew member" refers to anyone controlling or contributing to the control of a moving wheelchair, whether by way of applying tension to tensioning lines or by way of a rear-mounted steering column. In a typical mode of operation, the crew member at the rear of the chair (operating the steering column) acts the crew captain. FIGS. 18A-18D do not show a rider in the wheelchair seat, this is for simplicity of the image and to focus attention on crew members and the force they are exerting. In practice, of course, a rider is typically in the seat, but generally not physically engaged in controlling movement of the wheelchair. When a rider is in a wheelchair in the wheelchair mode, the rider, of course can operate the wheelchair by manipulating the rear wheels in a conventional manner.

Figure 18A:
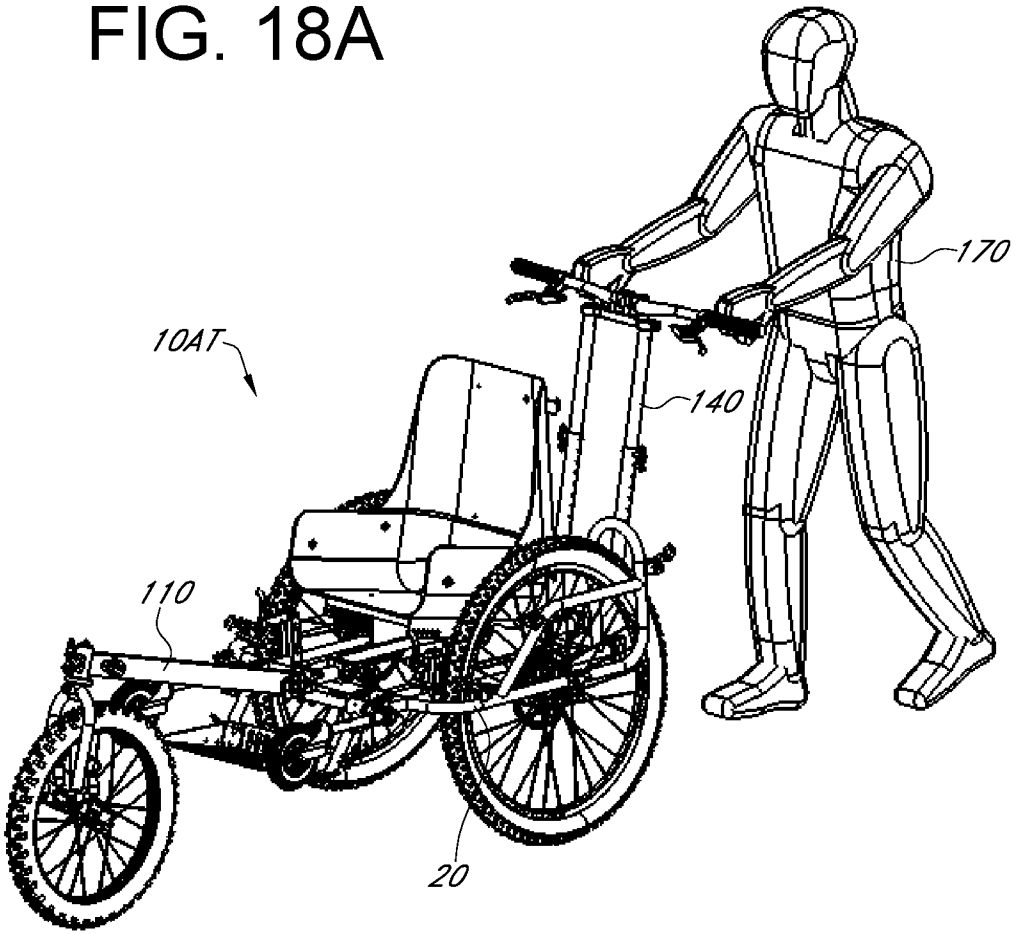
FIG. 18A shows a method of controlling movement of an embodiment of a wheelchair, wherein the chair is being moved by a crew member at the rear of the wheelchair (the cockpit position) on a flat surface, the crew member engaging the handlebar of the steering column and the brake levers disposed thereon.

FIG. 18A shows a method of controlling movement of an embodiment of a wheelchair. The chair is being moved by a crew member 170 at the rear of the wheelchair (the cockpit position), pushing the wheelchair forward on a level surface, the crew member 170 engaging the handlebar of the steering column 140 and the brake levers disposed thereon. The single crew member at the rear of the chair may be joined by the efforts of other crew members at any one or more of various positions, as shown in FIG. 18B.

Figure 18B:
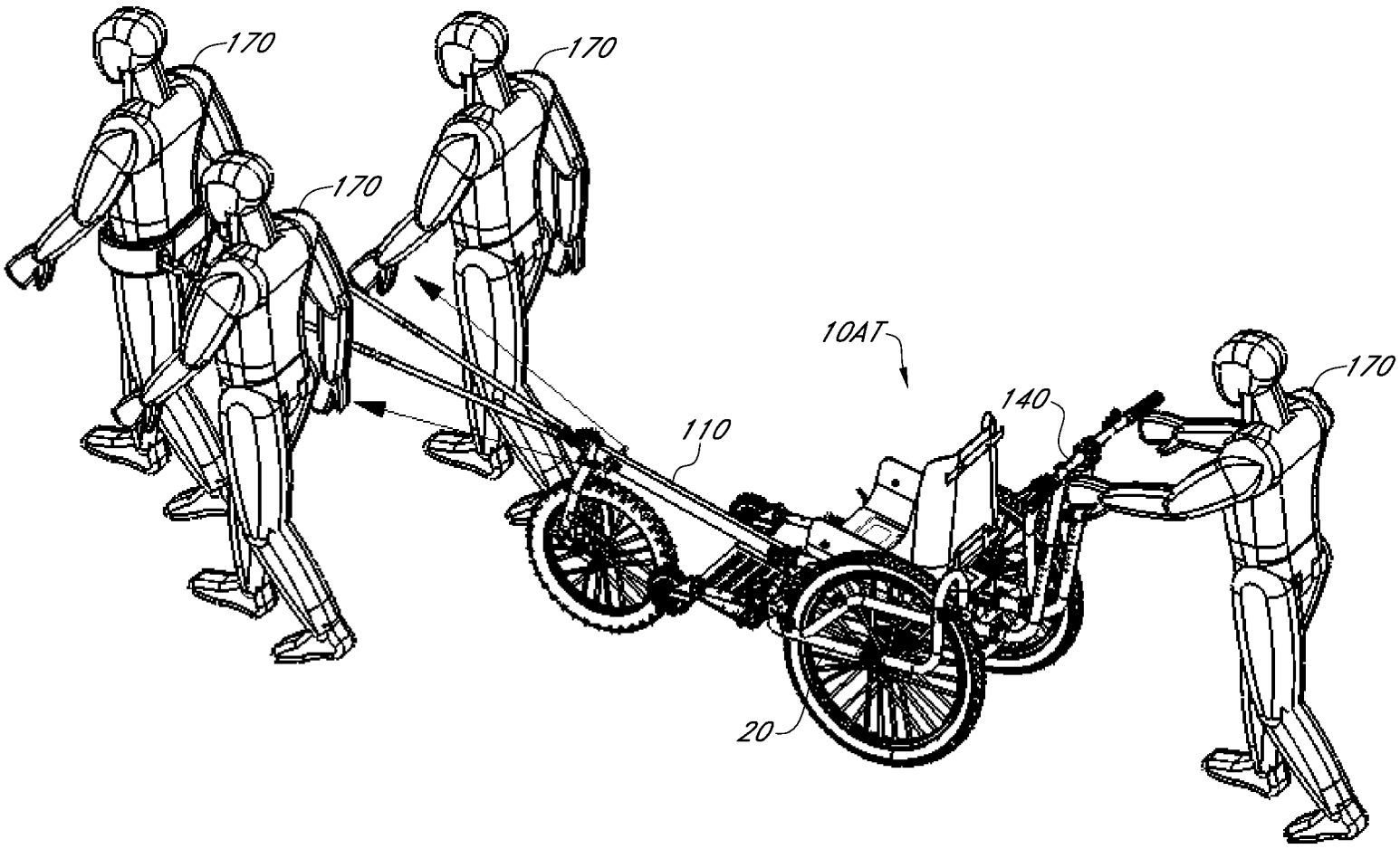
FIG. 18B shows a method of controlling movement of an embodiment of a wheelchair, wherein the chair is being moved by crew members on an uphill surface.

FIG. 18B shows a method of controlling movement of an embodiment of a wheelchair, wherein the chair is being moved by crew members 170 on an uphill surface. Up to 5 crew members can be engaged in ascending tension as required by percent and duration of the grade that is encountered along with the crew member pushing from the rear by way of a steering column 140.

Figure 18C:
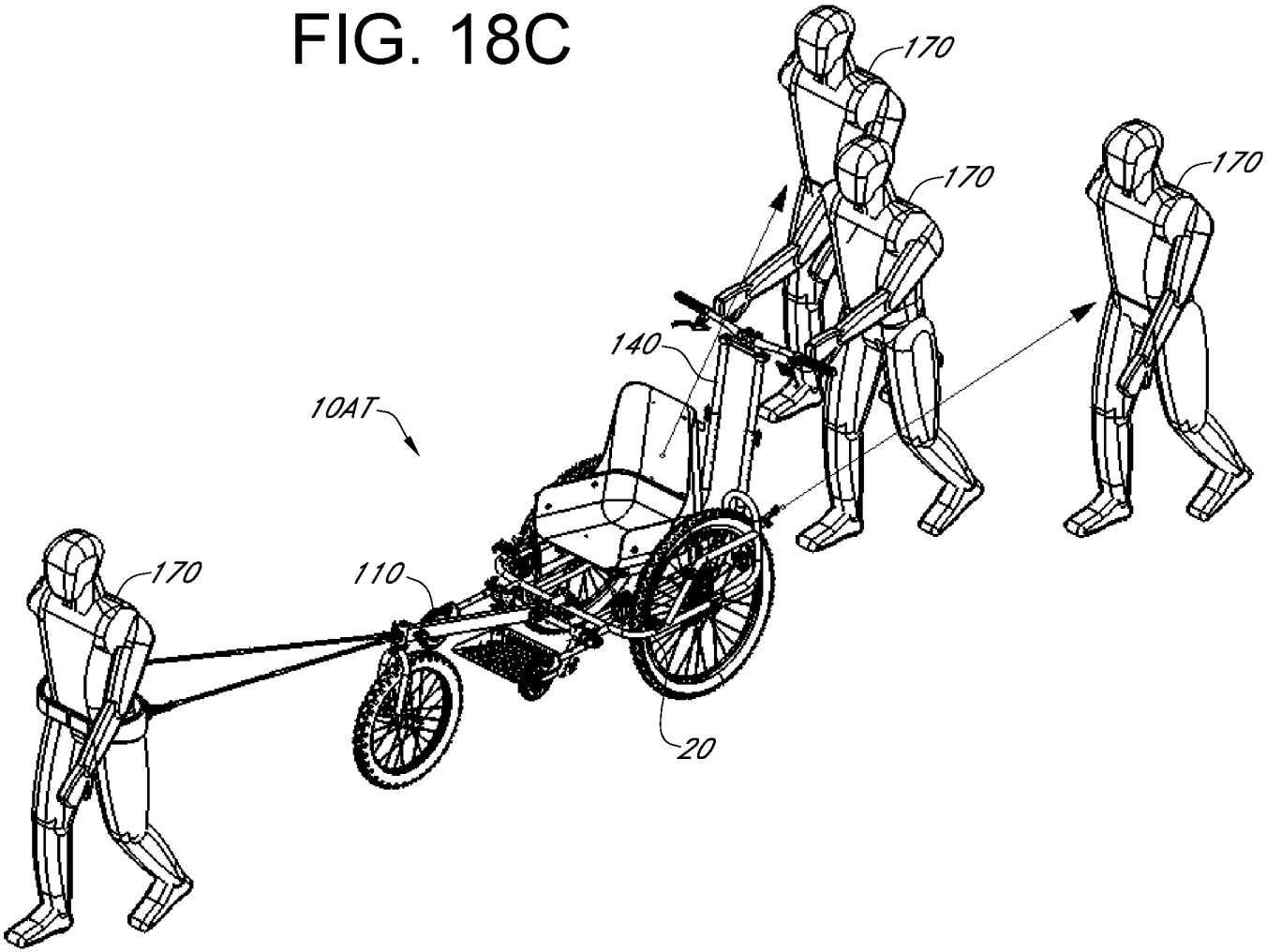
FIG. 18C shows a method of controlling movement of an embodiment of a wheelchair, wherein movement of the chair is being controlled by crew members on a downhill surface.
Figure 18D:
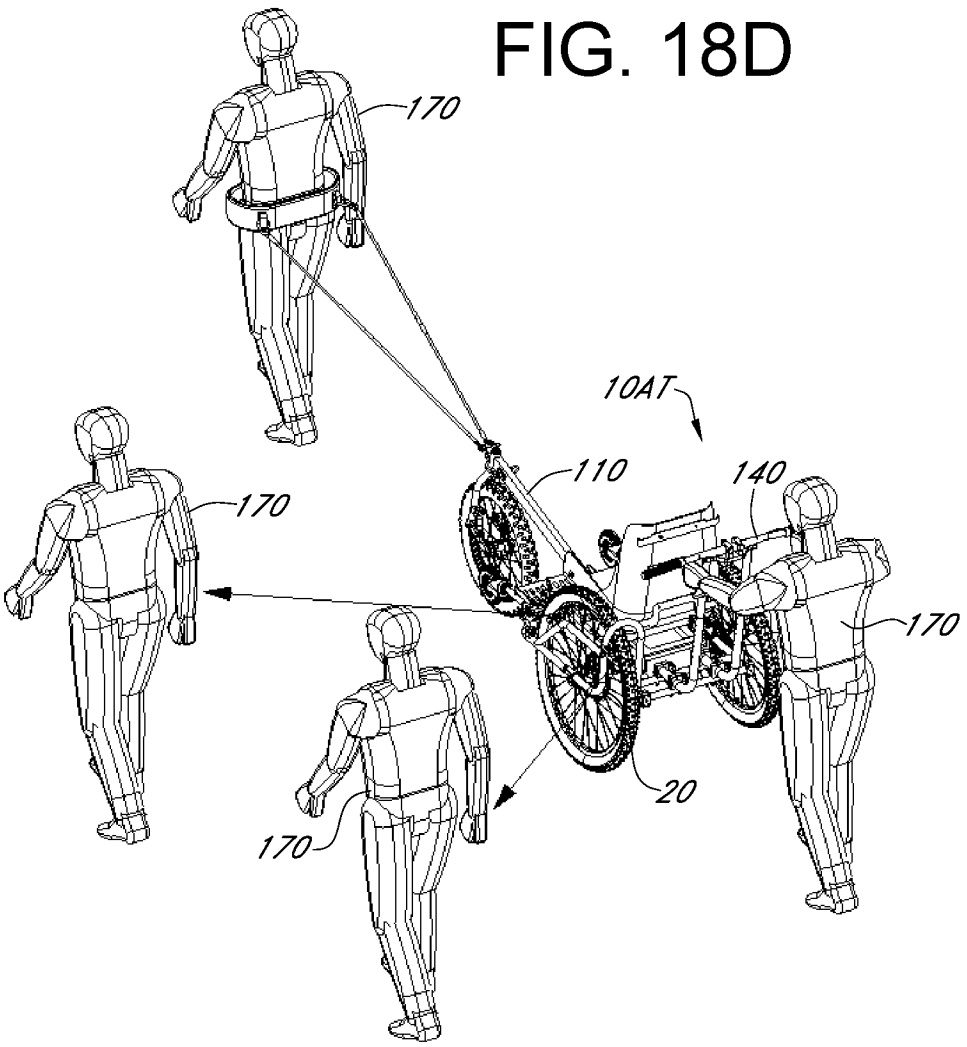
FIG. 18D shows a method of controlling movement of an embodiment of a wheelchair, wherein the chair is being moved forward by crew members on a laterally angled surface.

FIG. 18C shows a method of controlling movement of an embodiment of a wheelchair, wherein movement of the chair is being controlled by crew members 170 on a downhill surface. Controlling movement on a downhill surface includes constraining forward movement. Constraining movement includes operating brakes on the handlebar portion of the steering column. Most of the braking is done by the crew member 170 at the handle bars (cockpit), however the rearward crew assistants are engaged in constraining movement and as a failsafe in the case of the crew member at the rear of the chair stumbles or becomes disengaged from the handle bars.

FIG. 18D shows a method of controlling movement of an embodiment of a wheelchair. The wheelchair is being moved forward by crew members 170 on a laterally angled or off-camber surface. Crew members 170 are engaged in lateral tension to counteract tipping forces as encountered in off camber terrain. The crew member positioned behind the wheelchair, at the steering column 140 also controls the roll of the all-terrain wheelchair by applying lateral force to the cockpit handlebars to counteract the tipping forces that are encountered in off camber terrain.

Any one or more features of any embodiment of the invention, a convertible wheelchair or a method of wheelchair operation, can be combined with any one or more other features of any other embodiment of the invention, without departing from the scope of the invention. It should also be understood that the invention is not limited to the embodiments that are described or depicted herein for purposes of exemplification, but is to be defined only by a fair reading of claims appended to the patent application, including the full range of equivalency to which each element thereof is entitled.

The invention claimed is:

1. A convertible wheelchair system, convertible between a wheelchair configuration and an all-terrain configuration, the wheelchair system comprising:

a central frame aligned along a central longitudinal axis, the central frame comprising:

a front bar and a back bar parallel to each other and orthogonal to the central longitudinal axis, paired side bars, each aligned with the central longitudinal axis, and paired wheel cages, each aligned with the central longitudinal axis and attached to the front and back bars;

a forward beam alignable with the central longitudinal axis, the beam comprising a front end and a back end, wherein the front end of the forward beam is configured to support a forward wheel, and wherein the back end of the beam is configured to be attachable to- and detachable-from the front bar of the frame, wherein the convertible wheelchair is in the all-terrain configuration when the forward beam is attached to the frame, thereby forming a full all-terrain wheelchair frame, and wherein the convertible wheelchair is in the wheelchair configuration when the forward beam is detached from the frame, the central frame thereby standing alone.

2. The convertible wheelchair of claim 1 in an all-terrain configuration, the all-terrain wheelchair comprising a full frame for the all-terrain wheelchair configuration, the full frame comprising the forward beam and the central frame connected together.

3. The convertible wheelchair of claim 1 further comprising a plurality of tensioning line attachment sites on the central frame and/or on the forward beam, wherein these sites can anchor a tensioning force sufficient to control a movement of the chair, wherein the tensioning force is exerted by a crew member and conveyed through a tensioning line to the tensioning line attachment site.

4. The convertible wheelchair of claim 3 wherein individual tensioning line attachment sites on the central frame are arranged to attach to a tensioning line that can apply tensioning force in a range of directions, said directions comprising any one or more of a forward pulling tension, a lateral pulling tension, or a rearward pulling tension.

5. The convertible wheelchair of claim 3 wherein individual tensioning line attachment sites on the forward beam are arranged to attach to a tensioning line that can apply tensioning force in a range of directions, said directions comprising any one or more of a forward pulling tension, a lateral pulling tension, or a rearward pulling tension.

6. The convertible wheelchair of claim 3 further comprising one or more tensioning lines, each of the one or more tensioning lines being attached to one of the plurality of tensioning line attachment sites on the central frame of the wheelchair or on the forward beam.

7. The wheelchair of claim 1 wherein the forward beam comprises a rectangular cross-sectional profile.

8. The wheelchair of claim 1 wherein the forward beam, when attached to the frame according to the all-terrain configuration, is disposed at an angle $\alpha$ relative to a ground surface upon which the wheelchair is resting, and wherein a tensioning line attached to the front end of the forward beam, when being pulled by a crew member, forms an angle relative to the ground surface that is substantially aligned with angle $\alpha$.

9. The wheelchair system of claim 1 wherein the forward wheel is mounted on the forward beam by a trailing link type of suspension.

10. The wheelchair system of claim 1, further comprising a forward bar supported by the front bar of the central frame and parallel thereto, the forward bar providing support for a pair of caster wheels (left and right) and a footrest, all supported on the forward bar, each of the caster wheels and the footrest independently rotatable thereon.

11. The wheelchair system of claim 1, wherein each of the paired wheel cages comprises an exterior rail, a clevis arch, and inner rail comprising a sidebar of the central frame, and a buttress extending between the exterior rail and the clevis arch.

12. The paired wheel cages of claim 11, wherein each buttress comprises a lifting site configured to facilitate lifting of the wheelchair by a crew member, wherein the lifting site is substantially horizontal with respect to a ground surface upon which the wheelchair is positioned.

13. The wheelchair system of claim 1, further comprising an axle supported within each wheel cage.

14. The wheelchair system of claim 1, wherein each of the axles are positioned in a wheel cage at a camber of between about 1° degree to about 9° downward from a horizontal alignment.

15. The wheelchair of claim 1, further comprising a steering column supported by the rear bar of the central frame, the steering column projecting upward and supporting a steering bar, wherein the steering column comprises an adjustable height configuration.

16. The wheelchair of claim 1, further comprising a seat mounting assembly mounted on paired support bars disposed between the back and front bars of the central frame, the seating mounting assembly comprising paired sides and a seat-supporting platform disposed between the paired sides.

17. A three-wheeled all-terrain wheelchair comprising:

a full wheelchair frame aligned along a central longitudinal axis, the frame comprising a central frame and a forward beam fixedly connected together, wherein the central frame comprises a front bar and a back bar parallel to each other and orthogonal to the central longitudinal axis, a forward front bar, in front of- and parallel to the front bar, paired side bars, each aligned with the central longitudinal axis, and paired wheel cages, each wheel cage aligned with the central longitudinal axis and attached to the front and back bars of the frame, and each configured to support a rear wheel; and wherein the forward beam is aligned with the central longitudinal axis, and comprises a front end and a back end, wherein the front end of the forward beam is configured to support a forward wheel, and wherein the back end of the forward beam is connected to the central frame.

* * * * *